US006895212B2

(12) United States Patent
Yamakawa et al.

(10) Patent No.: US 6,895,212 B2
(45) Date of Patent: May 17, 2005

(54) PAPER POST-PROCESSING METHOD, PAPER POST-PROCESSING APPARATUS AND IMAGE RECORDING APPARATUS

(75) Inventors: Mikihiro Yamakawa, Tokorozawa (JP); Toshio Shida, Higashiyamato (JP); Teruhiko Toyoizumi, Tachikawa (JP); Masahiro Kaneko, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 0 days.

(21) Appl. No.: 10/731,703

(22) Filed: Dec. 8, 2003

(65) Prior Publication Data

US 2004/0120745 A1 Jun. 24, 2004

(30) Foreign Application Priority Data

| | | |
|---|---|---|
| Dec. 11, 2002 | (JP) | 2002-359215 |
| Dec. 18, 2002 | (JP) | 2002-366438 |
| Jan. 10, 2003 | (JP) | 2003-004320 |
| Mar. 25, 2003 | (JP) | 2003-081952 |

(51) Int. Cl.[7] ..... B41L 43/04

(52) U.S. Cl. ..... 399/407; 493/405; 493/435; 493/436; 493/458; 270/42; 270/58.08

(58) Field of Search ..... 270/20.1, 32, 37, 270/41–45, 52.18, 58.07, 58.08, 21.1; 399/407, 408, 410; 493/357, 416, 434, 435, 436, 442, 460, 405, 458

(56) References Cited

U.S. PATENT DOCUMENTS

| | | | | |
|---|---|---|---|---|
| 4,059,258 A | * | 11/1977 | Grantham | 493/29 |
| 4,701,233 A | * | 10/1987 | Beck et al. | 156/217 |
| 5,030,193 A | * | 7/1991 | Breton et al. | 493/458 |
| 5,037,368 A | * | 8/1991 | Breton et al. | 493/423 |
| 5,839,336 A | | 11/1998 | Yamauchi et al. | |
| 5,993,369 A | * | 11/1999 | Sekita et al. | 493/420 |
| 6,014,920 A | | 1/2000 | Yamauchi et al. | |
| 6,361,036 B1 | | 3/2002 | Nakazawa | |
| 6,568,668 B1 | | 5/2003 | Wakabayashi et al. | |
| 6,729,612 B2 | * | 5/2004 | Nagao et al. | 270/37 |
| 6,733,006 B2 | * | 5/2004 | Kobayashi et al. | 270/37 |
| 6,755,410 B2 | * | 6/2004 | Kaneko | 270/32 |
| 2002/0060388 A1 | * | 5/2002 | Wakabayashi et al. | 270/58.08 |
| 2002/0079640 A1 | | 6/2002 | Yoshie et al. | |
| 2003/0040415 A1 | | 2/2003 | Yamakawa et al. | |
| 2003/0057641 A1 | * | 3/2003 | Yamada et al. | 271/298 |
| 2003/0199377 A1 | * | 10/2003 | Driggers | 493/434 |

FOREIGN PATENT DOCUMENTS

| | | |
|---|---|---|
| EP | 0 960 704 A1 | 12/1999 |
| EP | 1 000 894 A2 | 5/2000 |
| JP | 10-148983 A | 6/1998 |
| JP | 2001-072321 A | 3/2001 |
| JP | 2001-261220 A | 9/2001 |
| JP | 3301195 B2 | 4/2002 |
| JP | 2003-063735 A | 3/2003 |

* cited by examiner

*Primary Examiner*—Eugene H. Eickholt
(74) *Attorney, Agent, or Firm*—Frishauf, Holtz, Goodman & Chick, P.C.

(57) ABSTRACT

A paper post-processing apparatus for folding a paper ejected from an image forming apparatus at a paper folding process section, having a pair of folding rollers; a pair of fold/transporting rollers each of which contacts with each of the pair of folding rollers; a driving unit; a folding roller moving unit; and a drive direction switching unit. When transporting a paper without folding the paper, the holding roller moving unit moves the folding rollers to a releasing position, and the drive switching unit switches the folding rollers to the same rotation direction with each other; and when folding the paper, the holding roller moving unit moves the folding rollers to the pressure contact position, and the drive switching unit switches the folding rollers to the reverse rotation direction with each other.

19 Claims, 27 Drawing Sheets

FIG. 13 (a)
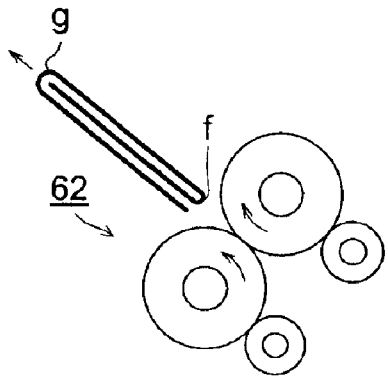
FIG. 13 (b)
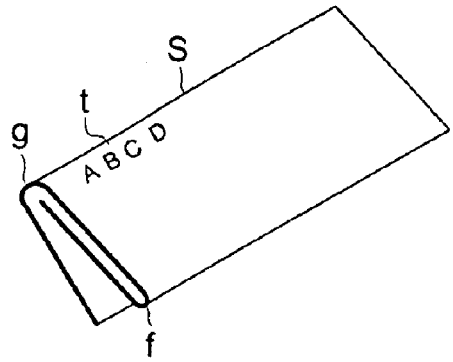
FIG. 13 (c)
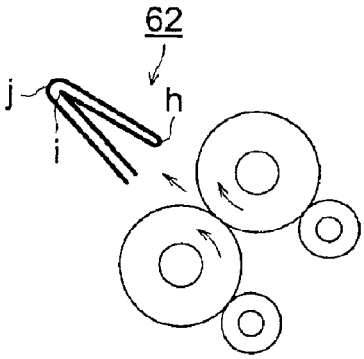
FIG. 13 (d)
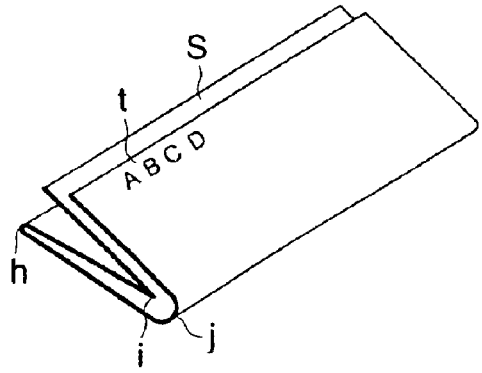
FIG. 13 (e)
FIG. 13 (f)
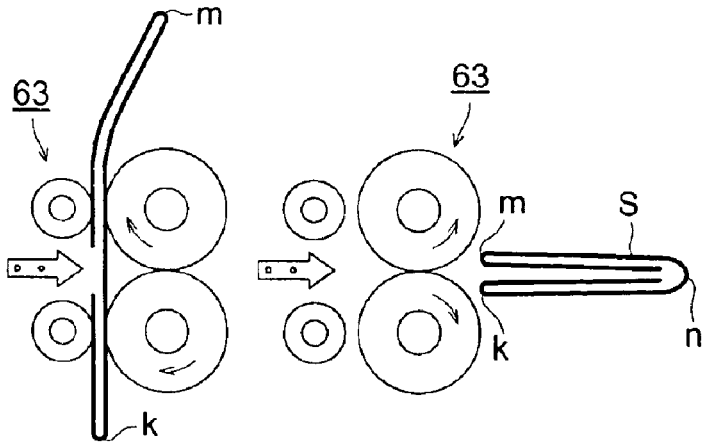

FIG. 15 ( a )
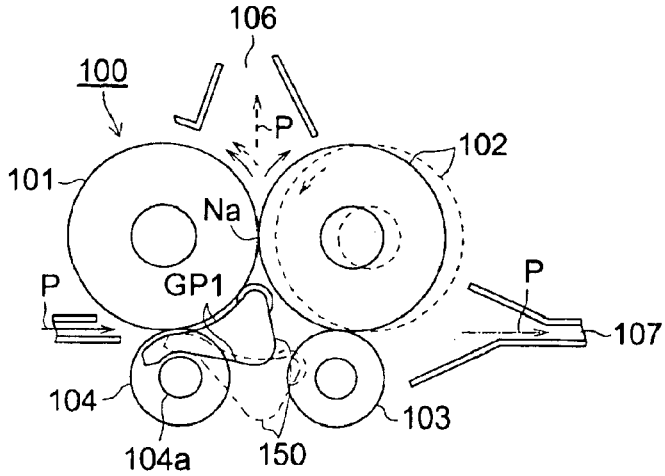
FIG. 15 ( b )
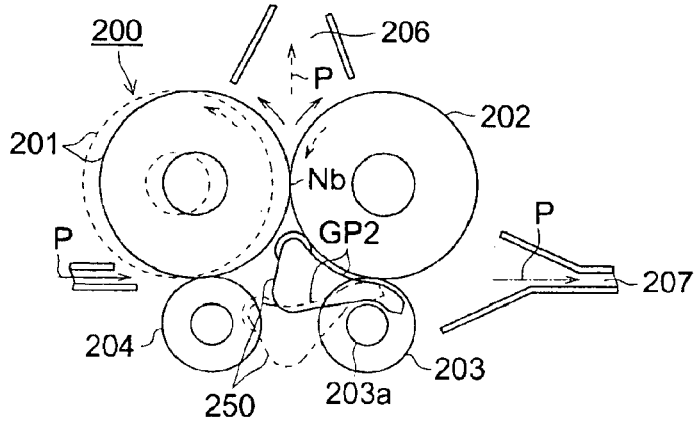
FIG. 15 ( c )
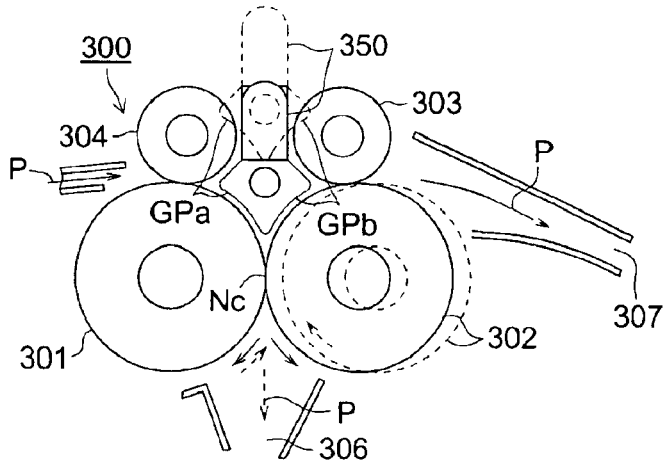

FIG. 16 ( a )
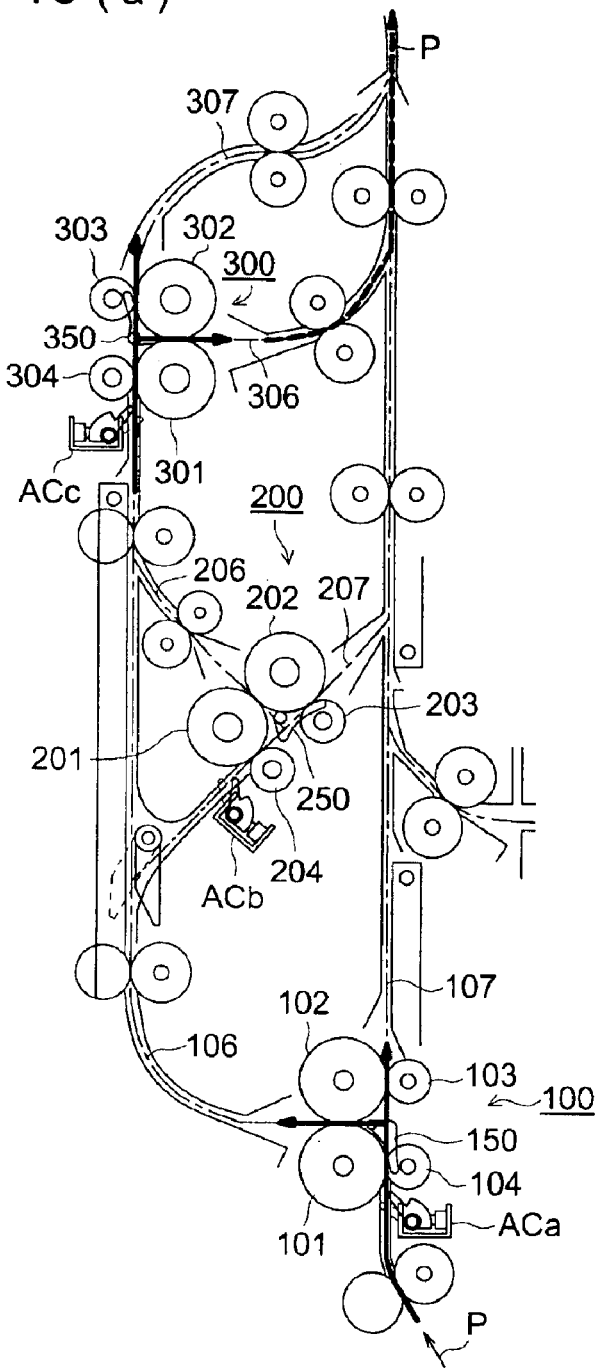
FIG. 16 ( b )
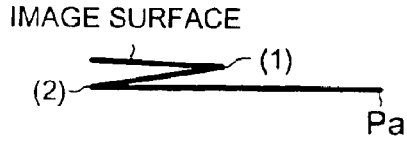

FIG. 17 ( a )
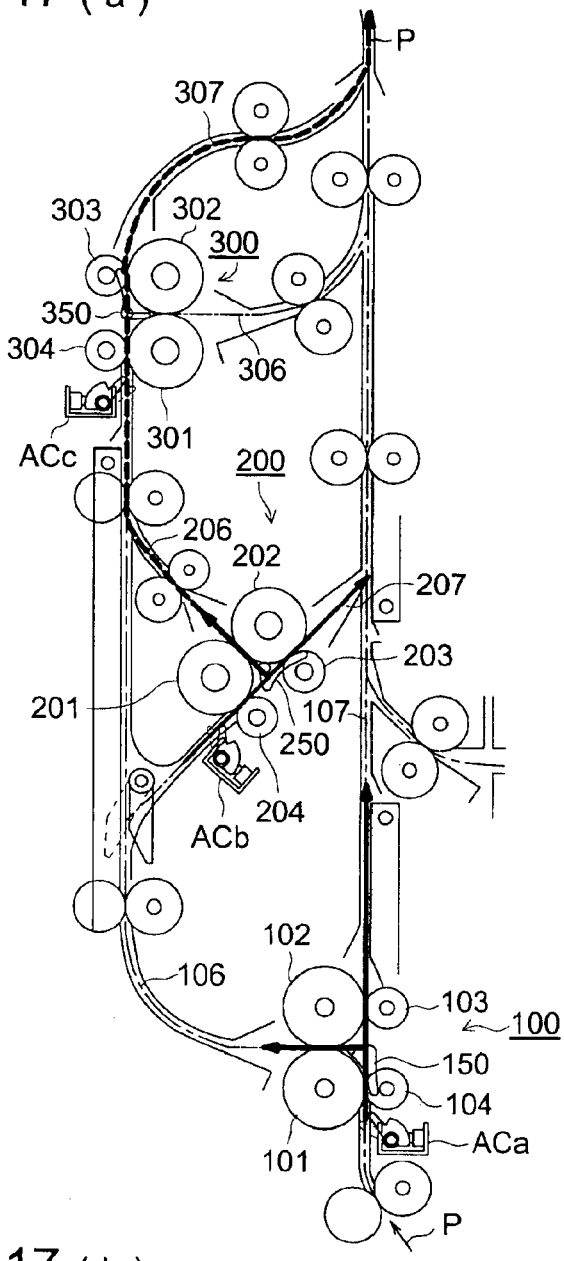
FIG. 17 ( b )
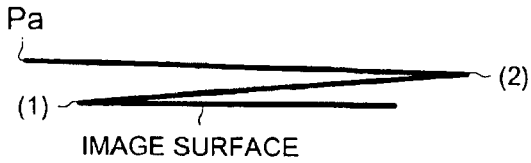

FIG. 19 ( a )
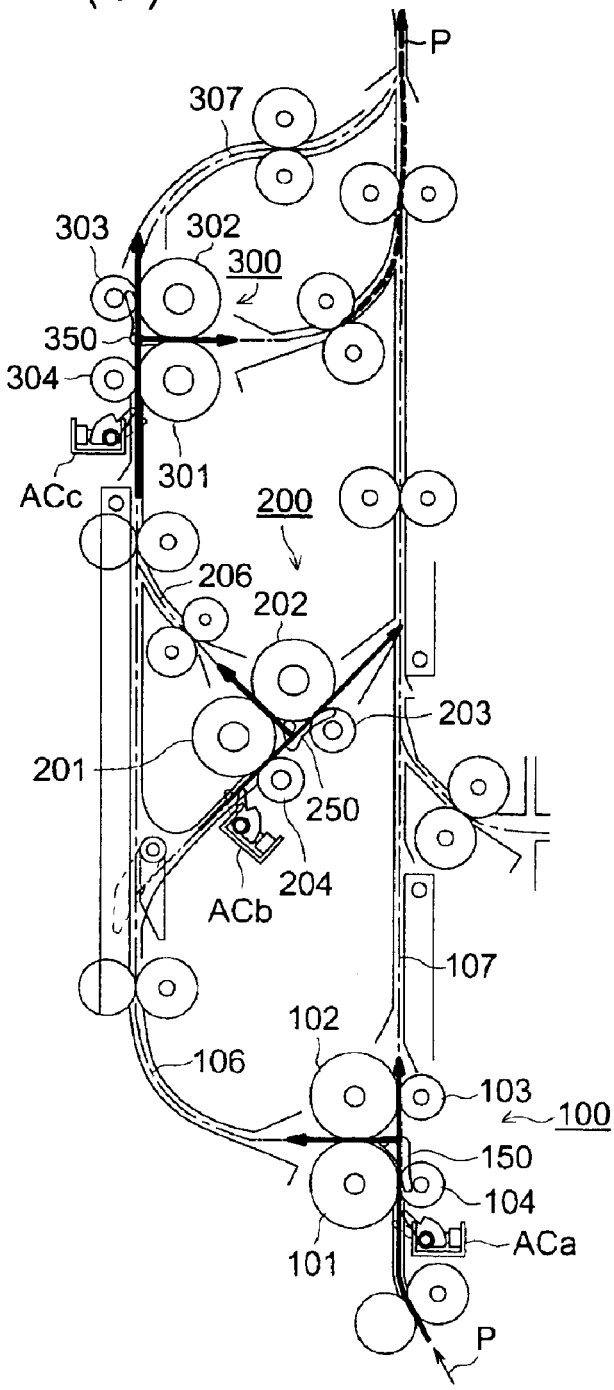
FIG. 19 ( b )
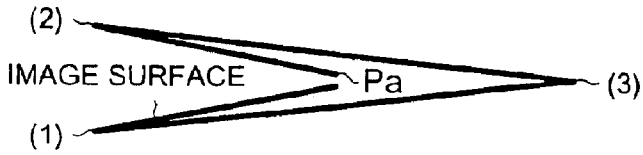

FIG. 20 ( a )
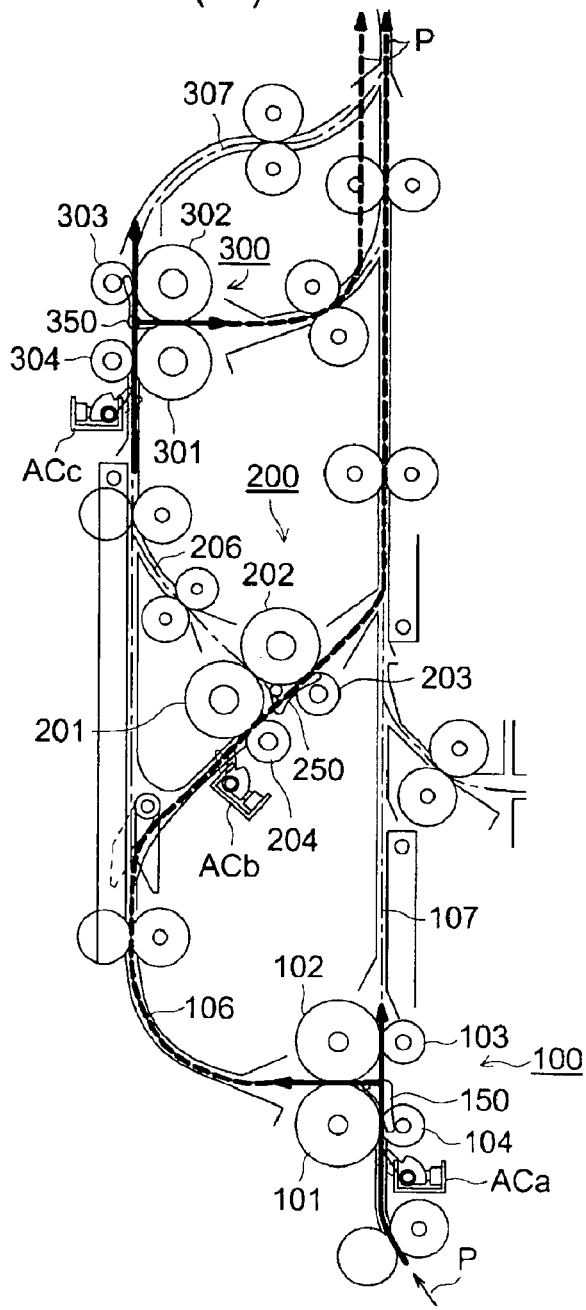
FIG. 20 ( b )
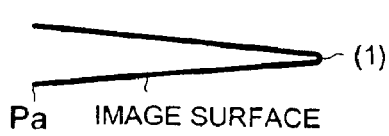
FIG. 20 ( c )
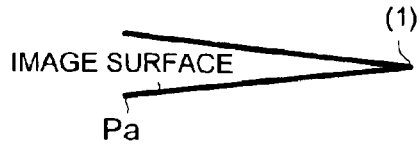

2 HOLES

3 HOLES

4 HOLES

PAPER POST-PROCESSING METHOD, PAPER POST-PROCESSING APPARATUS AND IMAGE RECORDING APPARATUS

BACKGROUND OF THE INVENTION

The present invention relates to a paper post-processing device that conducts folding processing such as z fold, outside three fold, inside three fold, double parallel fold, inside four fold, outside center fold and inside center fold for papers of paper ejected from image forming apparatuses such as an electrophotographic copying machine, a printer, a facsimile machine and a multifunctional machine having various functions of the aforesaid machines, and in particular, to space saving for a paper fold processing section that is composed of a pair of folding rollers and to reduction of driving loads for opening/closing of the paired folding rollers.

Further, the invention relates to the post-processing device that drills holes for filing with a punch at prescribed positions on the transported paper, an image forming system in which the post-processing devices are connected and to a method to punch holes on papers.

There are provided paper post-processing devices each conducting post-processing such as punching processing and fold processing on a paper on which an image is recorded by an image forming apparatus such as a copying machine, a printer, a facsimile machine and that conducts folding processing such as z fold, outside three fold, inside three fold, double parallel fold, inside four fold, outside center fold and inside center fold for papers of paper ejected from image forming apparatuses such as an electrophotographic copying machine, a printer, a facsimile machine and a multifunctional machine having various functions of the aforesaid machines, and in particular, to space saving for a paper fold processing section that is composed of a pair of folding rollers and to reduction of driving loads for opening/closing of the paired folding rollers.

The paper post-processing device disclosed in TOKKAIHEI No. 10-148983 is composed of a pair of upstream fold-transporting rollers in a paper transportation path, a pair of downstream fold-transporting rollers and a pair of folding rollers, and it double folds a paper.

In the paper post-processing device disclosed in TOKKAI No. 2001-72321, there have been conducted fold processing such as Z fold, inside three fold and center fold, on a single paper, in a paper bundle center fold processing section that conducts center fold processing for plural papers.

In the paper post-processing device disclosed in TOKKAI No. 2001-261220, Z fold processing for one paper is conducted in the first post-processing section, and center fold processing for plural papers and fold processing such as inside three fold and center fold for one paper are conducted in the second post-processing section arranged at the downstream side of a binding processing section.

(Patent Document 1)

TOKKAIHEI No. 10-148983 (Paragraph number 0011 and FIG. 2)

(Patent Document 2)

TOKKAIHEI No. 2001-72321

(Patent Document 3)

TOKKAIHEI No. 2001-261220

The conventional paper post-processing device that conducts fold processing has the following problems.

(1) In the paper processing device described in Patent Document 1, its structure is complicated because each of a pair of transporting rollers which form a loop on a paper and a pair of paper folding rollers is constructed. Further, since a pair of upstream transporting rollers and a pair of downstream transporting rollers are arranged to be away from each other, a space occupied by each of them is large, which makes space saving difficult.

Further, in the paper post-processing device described in Patent Document 1, a recording paper (paper) is folded, and it is folded in a convex form toward the roller side, then, it is necessary to open the folded paper again to transport it, thus, it has been impossible to fold while holding an end portion of the paper.

(2) In the paper post-processing device disclosed in each of Patent Document 2 and Patent Document 3, there is a problem that the device is complicated in structure and is large in size, because a paper is taken into an intermediate stacker temporarily and then is subjected to folding processing.

In the folding processing such as three fold, center fold and Z fold on a single paper, there is a fear that a paper transport failure occurs in a long paper transport path that is inclined and inflected, because a paper is transported to a paper bundle center fold processing section arranged at the downstream side of a binding processing section, and is subjected to fold processing.

A paper fold processing section of the paper post-processing device proposed in TOKUGAN No. 2001-253077 by the present applicant for solving the aforementioned problem is composed of an upstream folding roller, a folding roller that can be in pressure contact with the upstream folding roller, a downstream folding roller and a folding roller that can be in pressure contact with the downstream folding roller, and it functions as a pair of transporting rollers wherein upstream two rollers and downstream two rollers transport a paper to the downstream side when introducing the paper.

A leading edge of the paper is transported by two paired transporting rollers respectively in upstream side and downstream side to the prescribed position where folding processing can be conducted, and when the paired transporting rollers stop, the upstream folding roller that is held at a certain spatial distance (approx. 3 mm) for the downstream holding roller is brought into pressure contact with the downstream folding roller through a displacement means such as a solenoid, thus, a pair of folding rollers are formed, and papers can be folded.

However, the paper post-processing device stated above is of the construction wherein the upstream folding roller that is held by a swing lever plate is brought into pressure contact with the downstream folding roller through the displacement means including a solenoid, when folding papers. Therefore, a problem that the structure turns out to be complicated and grows greater is caused, and there is further caused a problem that a load for driving the folding roller to bring it into pressure contact and to release it is great.

Further, in recent years, there are provided post-processing devices each conducting punching processing automatically for papers, for filing papers on each of which an image is formed by an image forming apparatus such as an electrophotographic copying machine, a printer, a facsimile machine or a multifunctional machine having the functions of the aforesaid machines. Owing to this, it is possible for an operator to save time for binding outputted papers to set them on a business punch and for positioning them to punch as in the past, which has resulted in an office work that is extremely efficient.

In the post-processing device of this kind, if punching is performed under the condition that each paper is shifted or inclined, a position of the punched hole is also deviated, resulting in a problem that paper edges are not trued up to be unbecoming when they are filed.

Therefore, in the past, registration processing wherein papers are made to hit a member that is in the direction perpendicular to the direction of transportation has been conducted, or accuracy of parts of transportation member has been enhanced for coping with deviation and inclination of papers.

As an example for coping with the problems stated above, Patent Document (see Patent Document 4) discloses a paper admitting device wherein, when a trailing edge of a paper passes through the first transporting roller, a relative difference of transporting speed is given to the first transporting roller and the second transporting roller to curve the paper between both rollers and to make the trailing edge of the paper to touch the first transporting roller for determining a punched hole position.

(see Patent Document 4)

Japanese Patent No. 3301195 (page 2)

However, in Patent Document 4, positions of punched holes are not regulated in the lateral direction of papers although punched holes are positioned in the direction of transport of papers, thereby, punched holes are shifted in the lateral direction of papers and inclined.

The invention has been achieved in view of the problems mentioned above, and its another object is to provide a post-processing device wherein a structure is simple, papers are aligned so that positional deviations of the papers both in the transport direction and in the lateral direction may not be caused, and thereby, dispersion of punched hole positions is eliminated so that papers may not be unbecoming when they are filed, an image forming system to which the post-processing device is connected, and a paper punching method.

SUMMARY OF THE INVENTION (Means to Solve the Problems)

The problems stated above can be solved by the following features of the invention.

(1) A paper post-processing apparatus for folding a paper ejected from an image forming apparatus at a paper folding process section, the paper folding process section comprising: a pair of folding rollers contacting each other with a prescribed pressure, and each of the pair of folding rollers is rotatably supported by a shaft; a pair of fold/transporting rollers each of which contacts with each of the pair of folding rollers with a prescribed pressure, and is rotatable; a driving unit for driving the pair of folding rollers; a folding roller moving unit for moving the pair of folding rollers to a pressure contact position and to a releasing position; and a drive switching unit for switching a rotation direction of the pair of folding rollers;

wherein when transporting a paper without folding the paper at the paper folding process section, the holding roller moving unit moves the pair of folding rollers to a releasing position, and the drive switching unit switches the rotation direction of the pair of folding rollers to the same direction with each other; and when folding the paper at the paper folding process section, the holding roller moving unit moves the pair of folding rollers to the pressure contact position, and the drive switching unit switch the rotation direction of the pair of folding rollers to the reverse direction with each other.

(2) The paper post-processing apparatus according to (1), the paper folding process section further comprising: a pair of gears, each of which is fixed to each shaft of the pair of folding rollers at the end part outside a paper feeding area, engaging with each other when the pair of folding rollers are in the pressure contact position; and an idler gear engaging selectively to the pair of gears, the idler gear moving to a release position when the pair of folding rollers are in the pressure contact position, and the idler gear moving to an engaging position in-between the pair of gears to transfer a driving force when the pair of folding rollers are in the releasing position;

wherein the drive switching unit switches the rotation direction of the pair of folding rollers by making the idler gear move to the engaging position and to the release position.

(3) The paper post-processing apparatus according to (2), wherein the drive switching unit comprises a cam and a follower roller following the cam.

(4) The paper post-processing apparatus according to (1) or (2), the paper folding process section further comprising: an opening/closing cam provided on a supporting shaft of one of the pair of folding rollers; a pressure contact member provided on a supporting shaft of the other one of the pair of folding rollers, and follows the opening/closing cam with pressure; an assist member that is arranged at the position symmetrical with the position of the pressure contact member about the supporting shaft of the one of the pair of folding rollers;

wherein the folding roller moving unit moves the pair of folding rollers to a pressure contact position and to a releasing position by driving the opening/closing cam.

(5) The paper post-processing apparatus according to (4), the drive switching unit comprising a drive switching cam for switching the rotation direction of the pair of folding rollers by cooperating with the opening/closing cam.

(6) The paper post-processing apparatus according to (4), wherein, the opening/closing cam is in a disc shape and is formed to be linearly symmetrical about a line crossing a center of the supporting shaft.

(7) The paper post-processing apparatus according to (4), wherein, the opening/closing cam is rotatable about the supporting shaft.

(8) The paper post-processing apparatus according to (4), wherein, each of the pressure contact member and the assist member is a follower roller in a disc shape and is rotatable about the respective supporting shaft.

(9) The paper post-processing apparatus according to (4), wherein, drive transmission among the opening/closing cam, the pressure contact member and the assist member is conducted through frictional contact.

(10) The paper post-processing apparatus according to (1) or (2), further comprising: a sensor provided at an upstream side of a nipping position of the pair of folding rollers in the direction of paper transportation; and a control unit;

wherein after the sensor detects the passage of a leading edge of the paper, the control unit counts prescribed pulses, then, stops driving rotation of the pair of folding rollers and rotation of the pair of fold/transporting rollers to stop the paper at the prescribed position.

(11) An image recording apparatus comprising: an image recording section for recording an image on a paper; and a paper post-processing section for folding the paper; the paper post processing section comprises a first folding process section, a second folding process section and a third folding process section, all the three folding process sections being provided in a paper transportation path and selectively conduct a paper folding process; the paper transportation path comprising a first transportation path, a second transportation path, a third transportation path, and a transportation bypath; wherein, a paper folded at the first folding process section is led to the second folding process section or to the third folding process section through the first transport path, a paper folded at the second folding process section is led to the third folding process section through the second transport path, a paper to be transported without folded at neither of the first, the second or the third folding process section is transported to an exit through the transportation bypath, wherein a paper folding direction at the first and the second folding process sections is reverse to a folding direction at the third folding process section.

(12) The image recording apparatus according to (11), each of the first, the second and the third folding process sections comprising: a pair of folding rollers contacting each other with a prescribed pressure, and each of the pair of folding rollers is rotatably supported by a shaft;

a pair of fold/transporting rollers each of which contacts with each of the pair of folding rollers with a prescribed pressure, and is rotatable;

a driving unit for driving the pair of folding rollers;

a folding roller moving unit for moving the pair of folding rollers to a pressure contact position and to a releasing position; and a drive switching unit for switching a rotation direction of the pair of folding rollers, wherein when transporting a paper without folding the paper at the paper folding process section, the holding roller moving unit moves the pair of folding rollers to a releasing position, and the drive switching unit switches the rotation direction of the pair of folding rollers to the same direction with each other; and when folding the paper at the paper folding process section, the holding roller moving unit moves the pair of folding rollers to the pressure contact position, and the drive switching unit switch the rotation direction of the pair of folding rollers to the reverse direction with each other.

(101) A paper post-processing device for folding a paper at a paper fold processing section composed of a pair of folding rollers which transport a paper ejected from an image forming apparatus and support it rotatably by touching it with prescribed pressure load, and of a pair of transporting rollers which are brought into pressure contact with the paired folding rollers with a prescribed load, wherein there are provided a pair of gears each being fixed on the outside of a paper-feeding area of the end portion of each rotary shaft of the paired folding rollers to engage with each other, a driving means that drives the paired folding rollers to rotate, a folding roller moving means that moves the paired folding rollers to a pressure contact position and to a releasing position, an idler gear that engages selectively with the paired gears to move to a shunting position when the paired folding rollers are in the pressure contact position, and engages with the paired gears to transmit drive when the paired folding rollers have moved to the releasing position, and a drive switching means that moves the idler gear to the pressure contact position and to the releasing position, and when transporting a paper at the paper fold processing section, the paired gears are released by the folding roller moving means to disengage, and the drive switching means is driven to make the idler gear to engage with the paired gears so that the paired folding rollers may be rotated in the same direction, and when conducting paper fold processing at the paper fold processing section, the drive switching means is driven to make the idler gear to disengage from the paired gears, and the paired gears are made to engage by the folding roller moving means so that the paired folding rollers are rotated in the reverse direction.

(102) The paper post-processing device according to the Feature (101) wherein the folding roller moving means is composed of a cam and a roller that follows the cam.

(103) The paper post-processing device according to the Feature (101) wherein the drive switching means is provided with a cam and a roller that follows the cam.

(104) The paper post-processing device according to either one of the Features (101)–(103) wherein, with respect to the paper fold processing section, a plurality of them are arranged in the direction of paper transportation, and they makes it possible to conduct folding processing such as center fold, Z fold, outside three fold, inside three fold, inside four fold, and double parallel fold.

(105) The paper post-processing device according to either one of the Features (101)–(104) wherein, a sensor is arranged at the upstream side of the position for holding the paired folding rollers in the direction of paper transportation, and after the sensor detects the passage of a leading edge of the paper, prescribed pulses are counted by a control means, then, driving of the driving means is stopped, and driven rotations of the paired folding rollers and of the paired fold-transporting rollers are stopped to stop the paper at the prescribed position.

(201) A paper post-processing device having a paper fold processing section which transports a paper ejected from an image forming apparatus by the paired folding rollers and by fold-transporting rollers which are in pressure contact each other with prescribed load to be rotatable, wherein the paper fold processing section is provided with an opening/closing cam arranged on the supporting shaft of the folding roller on one side among the paired folding rollers for making the paired folding rollers brought into pressure contact and released, a pressure contact member that is provided on the supporting shaft of the other folding roller and touches the opening/closing cam with pressure, an assist member that is arranged at the position that is symmetrical with the pressure contact member about the supporting shaft of the folding roller on one side, a paired folding rollers switching drive means that drives the opening/closing cam and conducts switching for making the paired folding rollers to be brought into pressure contact and to be released, a paired folding rollers reciprocal rotation switching drive means that has a drive switching cam for switching a direction of rotation of the paired folding rollers, interlocking with drive of the opening/closing cam, and a paper transportation drive means that can transport a paper between the paired folding rollers and the fold-transporting roller, or can transport in the direction to bend for the folding rollers.

(202) The paper post-processing device according to the Feature (201) wherein, the opening/closing cam is in a disc shape and is formed to be symmetrical linearly about an axis.

(203) The paper post-processing device according to the Feature (201) or (202) wherein, the opening/closing cam can rotate about the supporting shaft.

(204) The paper post-processing device according to either one of the Features (201)–(203) wherein each of the pressure contact member and the assist member is a follower roller in a disc shape and can rotate about the supporting shaft of each member.

(205) The paper post-processing device according to either one of the Features (201)–(204) wherein drive transmission among the opening/closing cam, the pressure contact member and the assist member is conducted through frictional contact.

(206) The paper post-processing device according to either one of the Features (201)–(205) wherein the paired folding rollers switching drive means is composed of a driving source for driving the opening/closing cam and of its transmission means.

(207) The paper post-processing device according to either one of the Features (201)–(206) wherein the paired folding rollers reciprocal rotation switching drive means can make the gear arranged on the supporting shaft of the paired folding rollers to be released from or to be brought into contact with the idler gear, through the drive switching cam.

(208) The paper post-processing device according to either one of the Features (201)–(207) wherein the paper detection sensor that detects a paper and the paper introduction sensor are provided.

(301) An image recording apparatus equipped with a paper post-processing device capable of conducting fold processing by providing a fold processing section that transports a single paper or plural papers in piles fed and drives them in the direction in which the paired folding rollers make the paper to bend, wherein three fold processing sections including the first fold processing section, the second fold processing section and the third fold processing section are provided on the paper post-processing device, papers folded in the first fold processing section can advance to the second fold processing section or the third fold processing section through the first transport path, papers folded in the second fold processing section can advance to the third fold processing section through the second transport path, and papers which are transported without being folded in the first fold processing section, the second fold processing section and the third fold processing section are transported to a paper ejection inlet through a bypass path, and the direction for folding papers in each of the first fold processing section and the second fold processing section in terms of the transport direction for the incoming papers is opposite to that for folding papers in the third fold processing section in the paper post-processing device.

(302) The image recording apparatus equipped with a paper post-processing device described in Feature 301, wherein the first, second and third fold processing sections have a guide means capable of moving between a guide position for guiding a paper edge portion toward a nipping point of a pair of folding rollers and a shunting position retreated from the guide position, and the guide means is possible to rotate on a upstream fold-transporting roller on the upstream side that serves as a center of rotation, in the first fold processing section, then, to rotate on a downstream fold-transporting roller on the downstream side that serves as a center of rotation, in the second fold processing section, and to move back and forth in the vicinity of the nipping point of the paired folding rollers in the direction perpendicular to the transport direction for papers in the third fold processing section.

(303) The image recording apparatus equipped with a wherein fold processing is conducted in both the first and third fold processing sections to conduct Z fold for the incoming paper whose image surface is closer to the folding roller of the first fold processing section and whose leading edge portion is a trailing edge of the image.

(304) The image recording apparatus equipped with a paper post-processing device described in Feature 301 or 302, wherein fold processing is conducted in both the first and second fold processing sections for the incoming paper whose image surface is closer to the folding roller of the first fold processing section and whose leading edge portion is a trailing edge of the image, to conduct outside three fold, inside three fold and double parallel fold processing for papers.

(305) The image recording apparatus equipped with a paper post-processing device described in Feature 301 or 302, wherein fold processing is conducted for the incoming paper whose image surface is closer to the folding roller of the first fold processing section and whose leading edge portion is a trailing edge of the image, in the first, second and third fold processing sections to conduct folding processing of inside four fold.

(306) The image recording apparatus equipped with a paper post-processing device described in Feature 301 or 302, wherein fold processing is conducted for the incoming paper whose image surface is closer to the folding roller of the first fold processing section and whose leading edge portion is a trailing edge of the image, in the first fold processing section to conduct folding processing of outside center fold.

(307) The image recording apparatus equipped with a paper post-processing device described in Feature 301 or 302, wherein fold processing is conducted for the incoming paper whose image surface is closer to the folding roller of the first fold processing section and whose leading edge portion is a trailing edge of the image, in the third fold processing section to conduct folding processing of inside center fold.

(401) A post-processing device equipped with a punching means (section) that conducts punching processing with a punch to make a hole for filing at a prescribed position on a transported paper, wherein there are provided transporting rollers which are composed of a driving roller and a driven roller to be arranged at the downstream side of the punching means in the transport direction for the paper, and nip the paper to transport it, an urging member that urges the driven roller in the direction to bring it into pressure contact with the driving roller, an actuator that releases, when energized, the driven roller from the pressure contact with the driving roller against urging force of the urging member, an aligning means that aligns the papers laterally in the direction of a paper width that is perpendicular to the transport direction for papers, and a stopper member that is arranged at the upstream side of the punch in the paper transport direction, and can be mounted on or dismounted from a transporting path for the papers, and the paper is nipped and transported by the transporting roller under the condition that the stopper member is retreated from the transporting path for the papers, then, the actuator is energized to release pinching of the paper by the transporting roller after at least the leading edge portion of the paper has passed through the punching means, and the paper is aligned laterally by the aligning means, then, energizing of the actuator is stopped so that the transporting roller may pinch the paper again, and punching processing is conducted on the paper by the punching means after the trailing edge of the paper hits the stopper member mounted on the transporting path for the paper.

(402) The post-processing device described in Feature 401, wherein the transporting roller is rotated inversely to transport the paper in the inverse direction after energizing of the actuator is stopped and the paper is pinched again by the transporting roller, thus, the trailing edge portion of the paper is made to hit the stopper member.

(403) The post-processing device described in Feature 401 or 402, wherein there is provided an inlet roller that introduces the paper placed at the upstream side of the punching means in the paper transporting direction to the punching means.

(404) The post-processing device described in either one of Features 401–403, wherein the actuator is a solenoid.

(405) The post-processing device described in either one of Features 401–404, wherein there are provided two pairs of the transporting roller and the actuator.

(406) An image forming system wherein each of the post-processing devices described in Features 401–405 is connected with an image forming apparatus that is provided with at least an image writing means, an image forming means, a paper transporting means and a control means.

(407) A paper punching method to punch a hole for filing at a prescribed position on a paper transported by means of a punch provided on a punching means, wherein there are provided a step in which the paper is nipped and transported by the transporting roller arranged at the downstream side of the punching means in the paper transport direction, and at least the leading edge of the paper is made to pass through the punching means, a step to energize an actuator and thereby to release interposing of the paper by the transporting roller, a step in which the paper is aligned laterally by an aligning means in the paper width direction perpendicular to the paper transport direction, a step in which energizing of the actuator is stopped and the paper is nipped again by the transporting roller, a step to mount a stopper means arranged at the upstream side of the punch in the paper transport direction in a transport path for the paper, a step to make the trailing edge of the paper to hit the stopper member, and a step in which the punching means conducts punching processing on the paper.

(408) The paper punching method described in Feature 407, wherein there is provided a step in which the transporting roller is rotated inversely to transport the paper in the opposite direction after the step in which energizing of the actuator is stopped and the paper is nipped again by the transporting roller.

(409) The paper punching method described in Feature 407 or 408, wherein the stopper member is retreated from the transport path for the paper during the step in which the paper is transported by the transporting roller to pass through the punching means.

(410) The paper punching method described in either one of Features 407–409, wherein the actuator is a solenoid.

BRIEF DESCRIPTION OF THE DRAWINGS

FIGS. 13(*a*)–13(*f*) respectively show front views of paper fold processing sections and perspective-views of the folded papers.

FIGS. 15(*a*)–15(*c*) are diagrams each showing each roller member and guide member provided on each of the first–third fold processing sections of the paper post-processing device B in FIG. 14.

FIGS. 16(*a*) and 16(*b*) are diagrams showing folding processing for Z fold in the paper post-processing device.

FIGS. 17(*a*) and 17(*b*) are diagrams showing folding processing for outside three fold in the paper post-processing device.

FIGS. 19(*a*) and 19(*b*) are diagrams showing folding processing for inside four fold in the paper post-processing device.

FIGS. 20(*a*)–20(*c*) are diagrams showing folding processing for outside center fold and inside center fold in the paper post-processing device.

Figure 27:
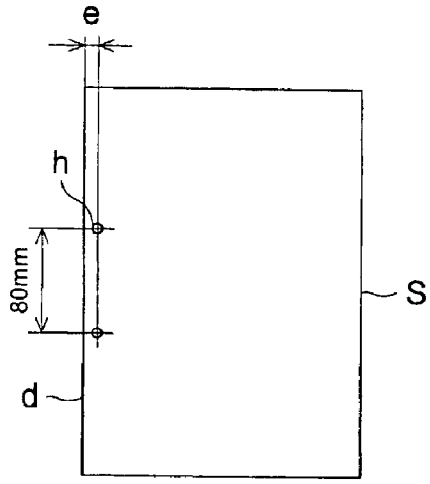
Figure 27:
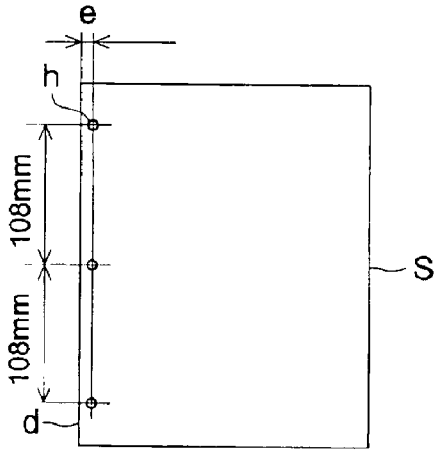
Figure 27:
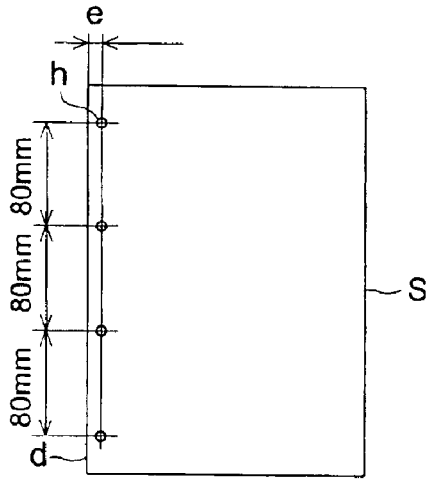

Each of FIGS. 27(*a*)–27(*c*) is a plan view showing an example of a type of the paper punched by a punching means.

DETAILED DESCRIPTION OF THE PREFERRED EMBODIMENT

Embodiment—1

Next, the paper post-processing device of the invention will be explained as follows, referring to the drawings.

Figure 1:
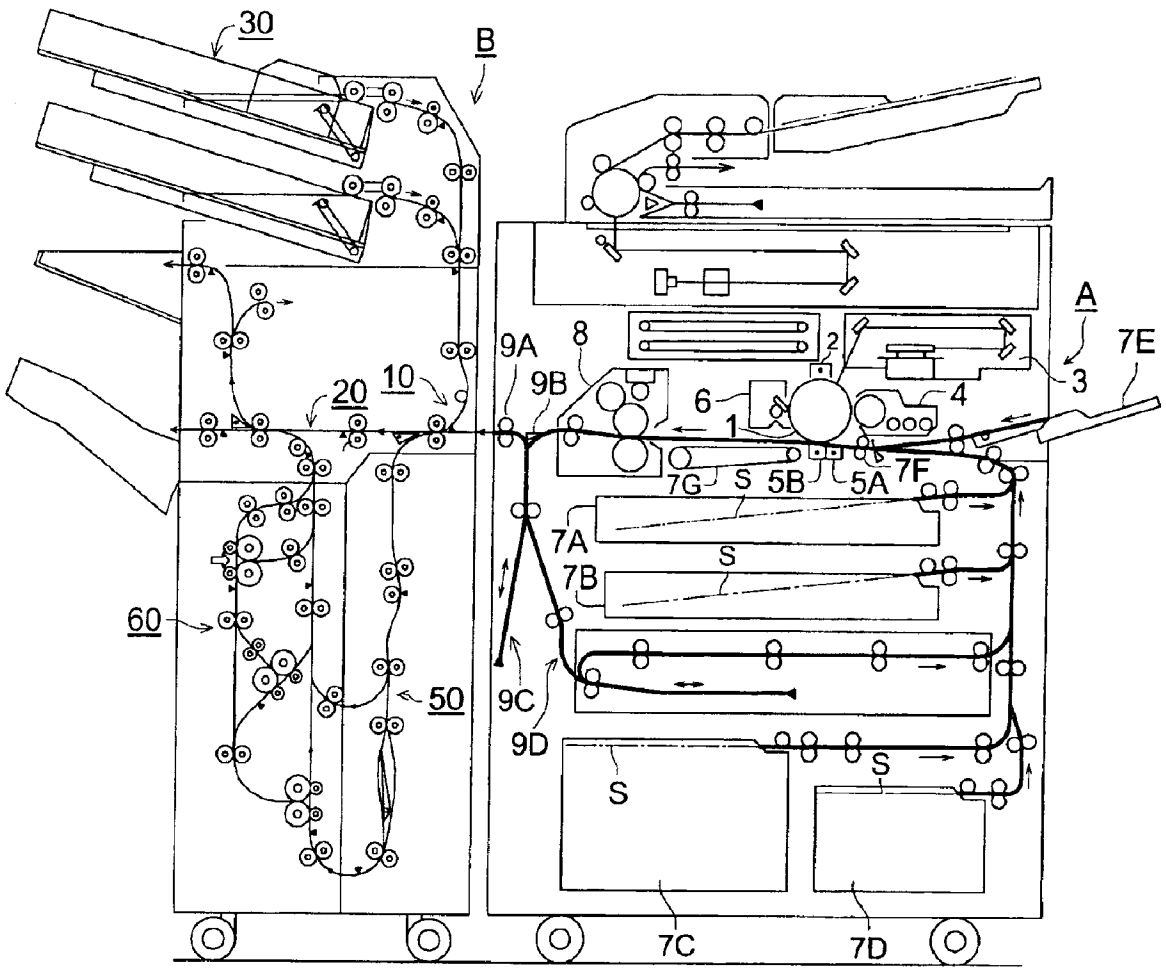
FIG. 1 is a diagram of the total structure including an image forming apparatus and a post-processing device.

FIG. 1 is a diagram of the total structure including image forming apparatus A and paper post-processing device (hereinafter referred to as a post-processing device) B.

The image forming apparatus A has an image forming section wherein charging unit 2, image exposure unit (image writing section) 3, developing unit 4, transfer unit 5A, neutralizing separation unit 5B and cleaning unit 6 are arranged around rotary electrostatic latent image carrier (hereinafter referred to as an image carrier) 1.

After a surface of the image carrier 1 is charged evenly by the charging unit 2, the image forming section conducts exposure scanning based on image data obtained from a document through reading by a laser beam of the image exposure unit 3, to form a latent image, and this latent image is subjected to reversal development by the developing unit 4, and a toner image is formed on a surface of the image carrier 1.

On the other hand, recording paper S that is fed from paper feeding cassette 7A or 7B arranged on an intermediate deck of the image forming apparatus A, or from large capacity paper feeding tray 7C or 7D arranged on a lower deck, or from manual feeding paper feeding tray 7E arranged on the side, is transported to the transfer position through registration roller 7F.

The toner image is transferred onto the recording paper S by the transfer unit 5A in the transfer position. After that, electric charges on the reverse side of the recording paper S are neutralized by the neutralizing separation unit 5B and thereby the recording paper S is separated from the image carrier 1 to be transported to paper transport section 7G, and then, the toner image is heated and fixed by fixing unit 8. The recording paper S which has passed through the fixing unit 8 passes through a paper feeding path located on the right side of transport path switching plate 9B to be fed into lower reversing transport section 9C, and then is reversed and lifted to pass through a paper feeding path located on the left side of transport path switching plate 9B, and is ejected by paper ejection roller 9A.

When forming images on both sides of the recording paper S, the recording paper S on which an image has been heated and fixed by the fixing unit 8 is branched from an ordinary paper ejecting path by the transport path switching plate 9B, and then is switched back on two-side transport portion 9D to be reversed upside down. Then, the recording paper S passes through the image forming section again to be subjected to image forming on its reverse side, and is ejected out of the apparatus by the paper ejection roller 9A, through the fixing unit 8.

On the other hand, the image carrier 1 after image processing is cleaned by the cleaning unit 6 so that developer staying on the surface of the image carrier 1 may be removed, to be ready for the following image forming.

Figure 2:
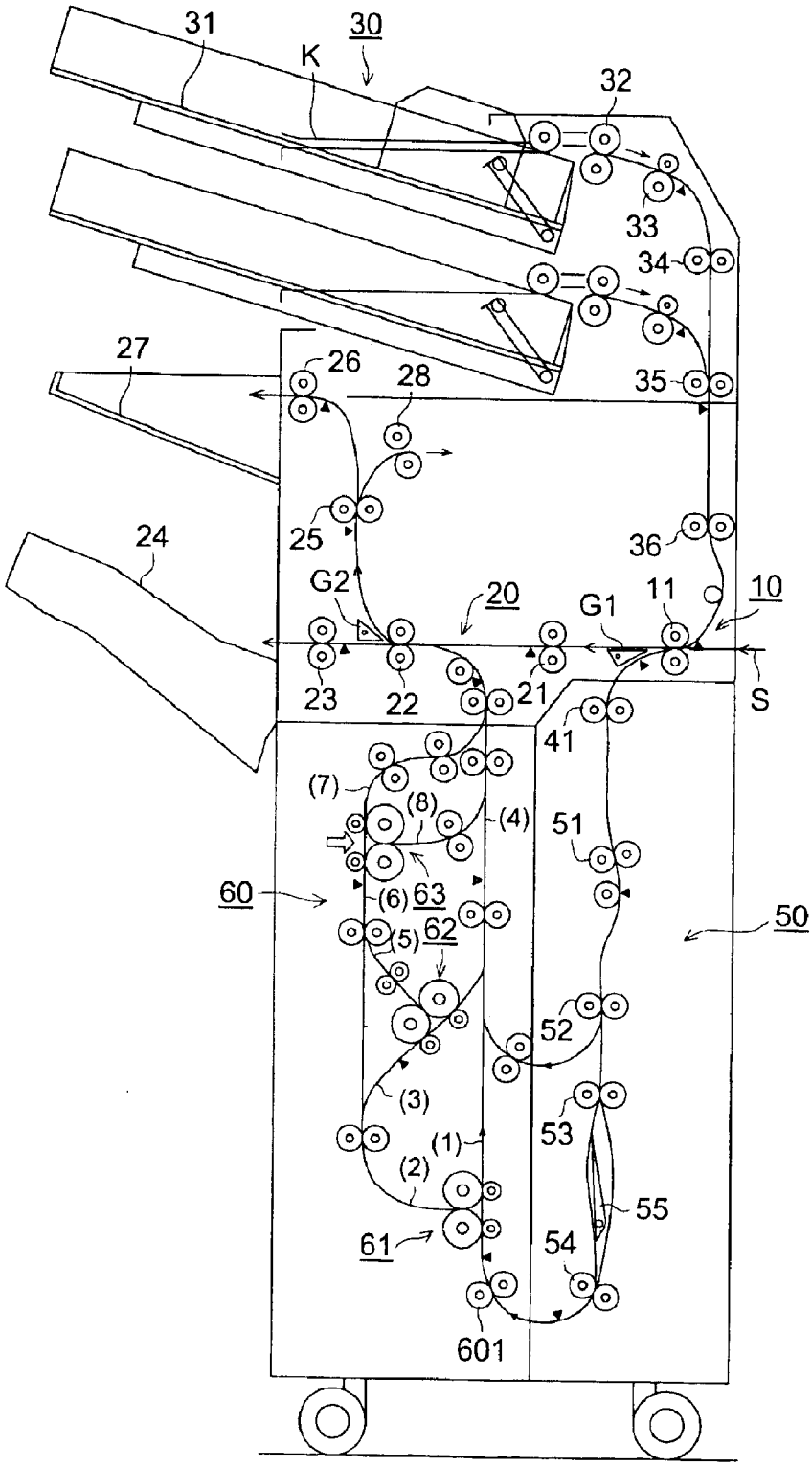
FIG. 2 is a diagram of the total structure of a post-processing device in the invention.

FIG. 2 is a diagram of the total structure of post-processing device B in the invention.

The post-processing device B is composed of acceptance section 10, paper ejection section 20, cover paper feeding section 30, transport section 50 and paper fold processing section 60.

Inlet roller 11 of the acceptance section 10 is installed to agree substantially with paper ejecting roller 9A of the image forming apparatus A in terms of a position and a height.

Recording paper S which has been subjected to image forming processing by the image forming apparatus A and cover paper K supplied from the cover paper feeding section 30 are introduced into the acceptance section 10.

Recording paper S and cover paper K both introduced to the inlet roller 11 are branched by transport path switching means G1 either to paper ejection section 20 or to transport section 50.

When paper transport of the paper ejection section 20 is established, the transport path switching means G1 opens a transport path to the paper ejection section 20.

Recording paper S passing through the transport path of the paper ejection section 20 is nipped by transporting rollers 21 and 22 to advance straight, then, is ejected by paper ejection roller 23 and is placed on elevating paper ejection tray (main tray) 24 to be piled up in succession. The elevating paper ejection tray 24 is constructed so that it can descend gradually when a large number of recording papers S are ejected to be piled on the elevating paper ejection tray 24.

Recording paper S branched by transport path switching means G2 to the upper portion in the drawing that is on the downstream side of transporting roller 22 in the paper transport direction passes through transporting roller 25 and is ejected by paper ejection roller 26 onto stationary paper ejection tray (sub-tray) 27 which is on the outer side of the apparatus, to be accepted thereon.

Cover paper K loaded in paper feeding tray 31 of the cover paper feeding section 30 is separated and fed by paper feeding means 32, and then, is nipped by transporting rollers 33, 34, 35 and 36 to be introduced into the acceptance section 10. Incidentally, it is also possible to load papers for insertion on the cover paper feeding section 30 to feed them.

Incidentally, it is also possible to load cover papers K, papers for insertion, or recording papers S on the cover paper feeding section 30, and to conduct folding processing on an off-line basis. Hereafter, recording paper S, cover paper K and paper for insertion are assumed to be called paper S collectively.

Paper S transported to the transport section 50 is nipped by transporting rollers 51, 52, 53 and 54 to be transported to paper fold processing section 60.

Paper S transported from the transport section 50 to paper fold processing section 60 is nipped by inlet roller 601 to be transported, and passes through either one of transport paths (1)–(8) to be subjected to various types of fold processing such as center fold, inside center fold, Z fold, outside three fold, inside three fold, inside four fold and double parallel fold in the first folding section 61, the second folding section 62 and the third folding section 63, to be ejected onto paper ejection section 20.

Figure 9:
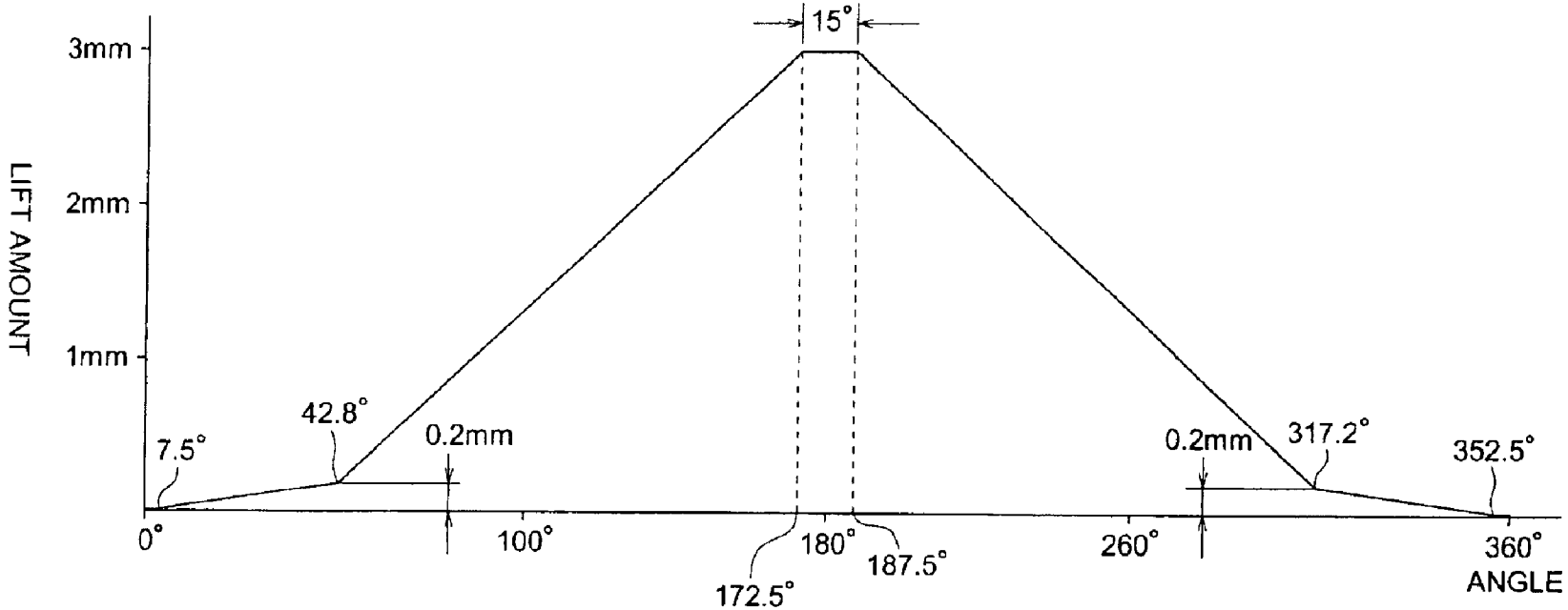
FIG. 9 is a diagram showing curve characteristic and its lift amount for an opening/closing cam.
Figure 10:
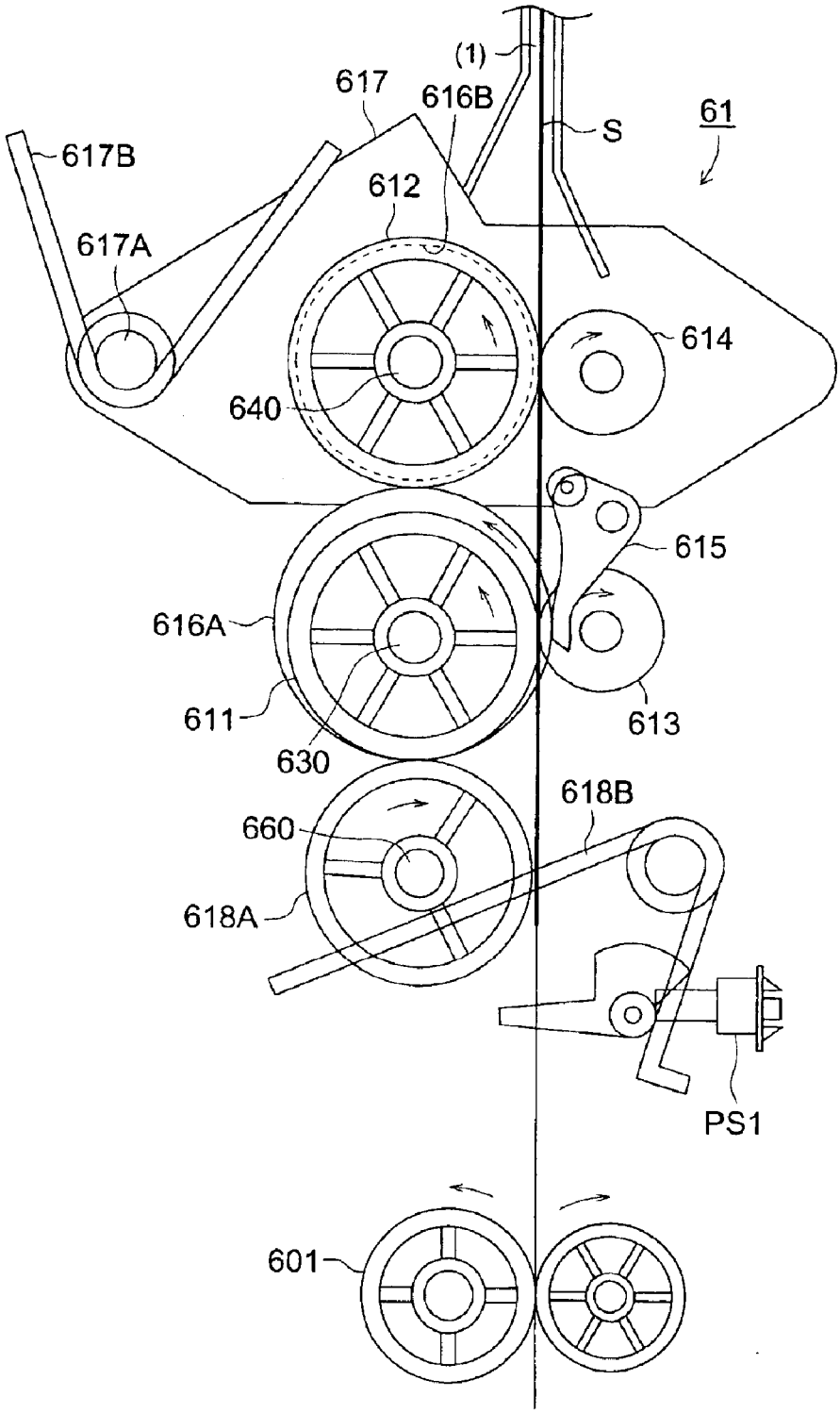
FIG. 10 is a diagram showing schematically the first folding section where a pressure contact member that operates to follow an opening/closing cam positioned at the center, and an assist member arranged on the position that is symmetrical with the pressure contact member.

FIGS. 9 and 10 will be used to describe later a pressure contact member and an assist member arranged at the position that is symmetrical with an opening/closing cam about that cam which makes a pair of folding rollers of the paper fold processing section of the invention to be brought into pressure contact and to be released.

An image diagram about the fold processing will be described schematically.

Figure 11:
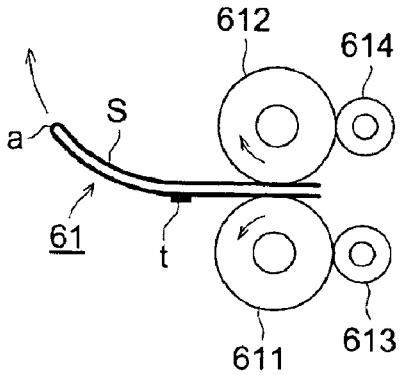
FIGS. 11(*a*)–11(*d*) respectively show a paper fold processing section for center fold and a perspective view of the folded paper.
Figure 11:
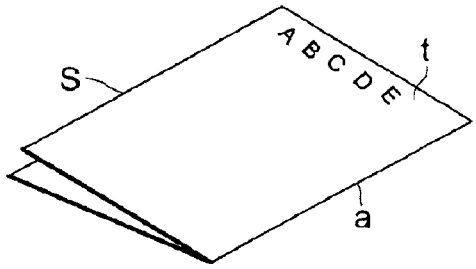
Figure 11:
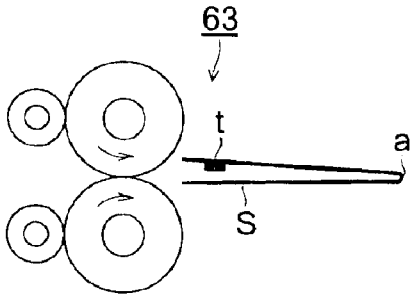
Figure 11:
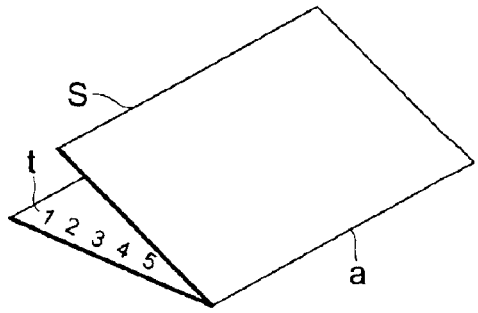

FIG. 11 shows a paper fold processing section for center fold and a perspective view of the folded paper S.

FIG. 11(*a*) is a front view of first folding section 61 and FIG. 11(*b*) is a perspective view of paper S which has been subjected to outside center fold.

Paper S which has been folded with its image surface t facing downward (outer side) is transported with its crease "a" facing front through transport paths (2)–(4).

FIG. 11(*c*) is a front view of third folding section 63 and FIG. 11(*d*) is a perspective view of paper S which has been subjected to inside center fold.

Paper S passes through the first folding section 61, then, is transported through transport paths (2) and (6), and it is folded with its image surface t facing inside by the third folding section 63 to be transported with its crease "a" facing front, through transport path (8).

Figure 12:
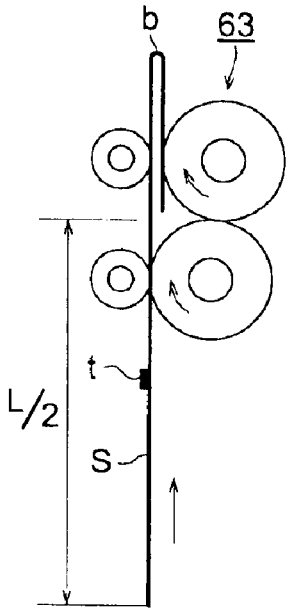
FIGS. 12(*a*)–12(*e*) respectively show paper fold processing sections and perspective views of the folded papers.
Figure 12:
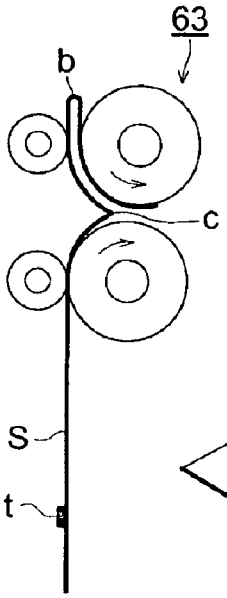
Figure 12:
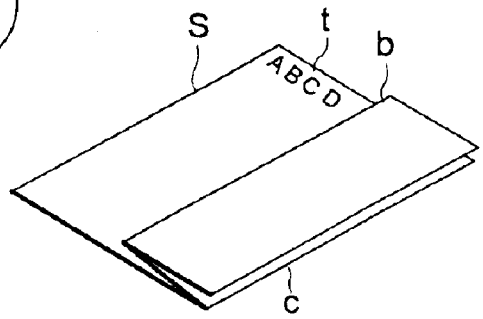
Figure 12:
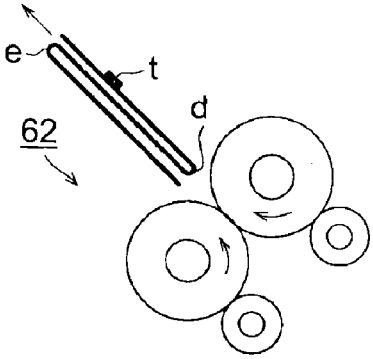
Figure 12:
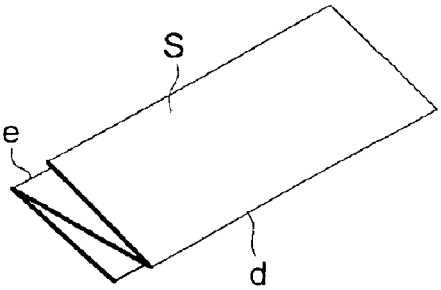

FIG. 12 shows paper folding sections and perspective views of folded papers S.

Each of FIGS. 12(*a*) and 12(*b*) is a front view of third folding section 63, and FIG. 12(*c*) is a perspective view of paper S that has been subjected to outside three fold (unequally folded).

Paper S is transported with its crease "b" formed by the first folding section 61 facing front through transport paths (2) and (6), then, is folded by the third folding section 63 and is transported with its crease c facing front through transport path (8).

FIG. 12(*d*) is a front view of the second folding section 62, and FIG. 12(*e*) is a perspective view of Z-folded paper S.

Paper S is folded on its trailing edge side by the first folding section 61 and is transported through transport paths (2) and (3) with its crease d facing front, and is Z-folded by the second folding section 62 to be transported through transport paths (5), (6) and (7).

FIG. 13 shows a front view of a paper fold processing section and a perspective view of the folded paper S. FIG. 13(*a*) is a front view of the second folding section 62 and FIG. 13(*b*) is a perspective view of inside-three-folded paper S.

Paper S is folded on its leading edge side by the first folding section 61 and is transported with its crease f facing front, and is three-folded by the second folding section 62 to be transported through transport paths (5), (6) and (7) with its crease g facing front.

FIG. 13(*c*) is a front view of the second folding section 62, and FIG. 13(*d*) is a perspective view of double-parallel-folded paper S.

Paper S is folded to be in a half size by the first folding section 61, and is transported with its leading edge facing front, and is further folded to be in a half size by the second folding section 62 to be transported through transport paths (5), (6) and (7) with its crease j facing front.

FIG. 13(*e*) is a front view of the third folding section 63, and FIG. 13(*f*) is a perspective view of inside-four-folded paper S.

Paper S is folded on its leading edge side by the first folding section 61, and is folded on its trailing edge side by the second folding section 62 to be transported through transport paths (5) and (6), and then, is folded by the third folding section 63 to be transported, with its crease n facing front, through transport path (8).

Figure 3:
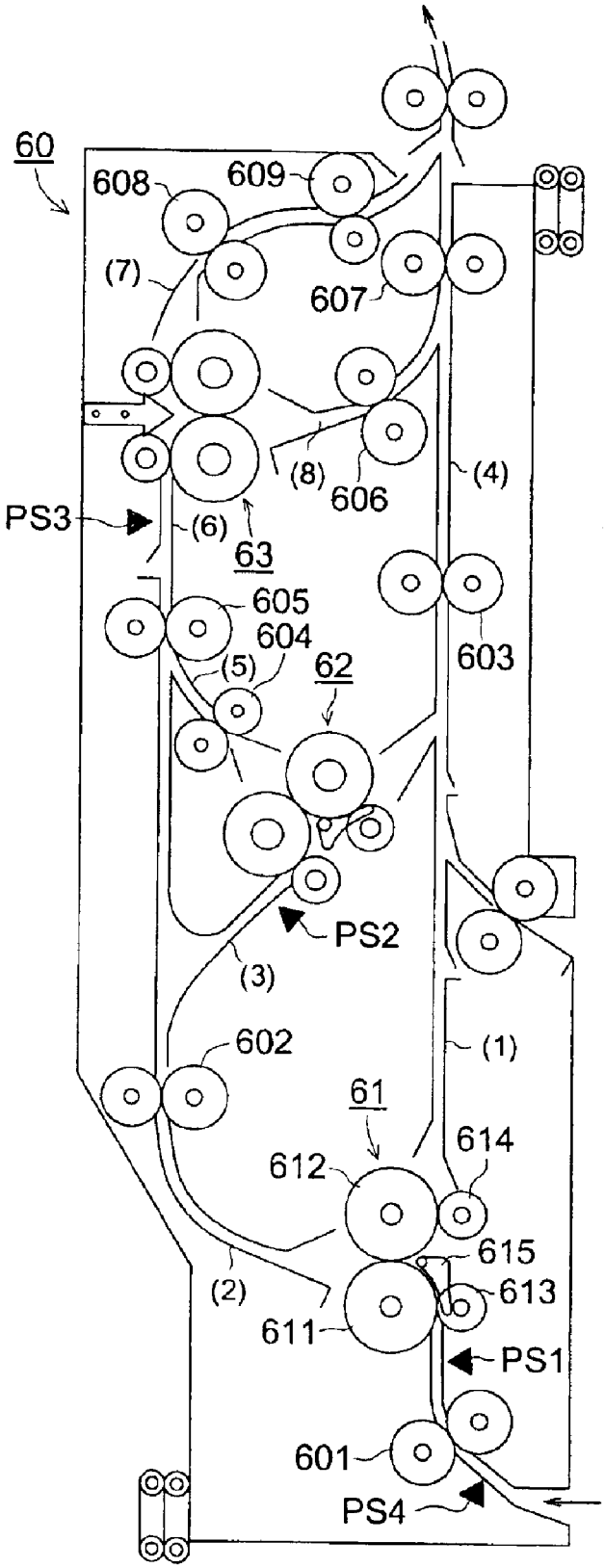
FIG. 3 is a sectional view of a paper fold processing section of the invention.

FIG. 3 is a sectional view of paper fold processing section 60 of the invention.

The first folding section 61 is composed of a pair of folding rollers including folding roller 611 and folding roller 612 capable of conducting pressure contact and releasing, fold-transporting roller 613 that is brought into pressure contact with the folding roller 611, fold-transporting roller 614 that is brought into pressure contact with the folding roller 612 and guide member 615 that pushes in paper S to the interposing position for the paired folding rollers to form a crease of the paper S. With respect to the second folding section 62 and the third folding section 63, their structures are substantially the same as that of the first folding section 61. However, the guide member 615 is arranged on the part of the fold-transporting roller 614 for the second folding section 62, while, a wedge-shaped guide member is supported to be capable of reciprocating in the direction perpendicular to the paper transport direction and in the direction of a common tangent at the nip position of both folding rollers.

On the paper fold processing section 60, there are arranged a plurality of transport paths (1)–(8) which connect the first folding section 61, the second folding section 62 and the third folding section 63, and a plurality of transporting rollers 602–609 which nip paper S to transport it.

Since each paper transporting means, each of paper detection sensors PS1, PS2 and PS3, paper incoming sensor PS4 that detects incoming of the paper and each driving means in each of the first folding section 61, the second folding section 62 and the third folding section 63 are of substantially the same structure, the first folding section 61 will be explained typically as follows.

Figure 4:
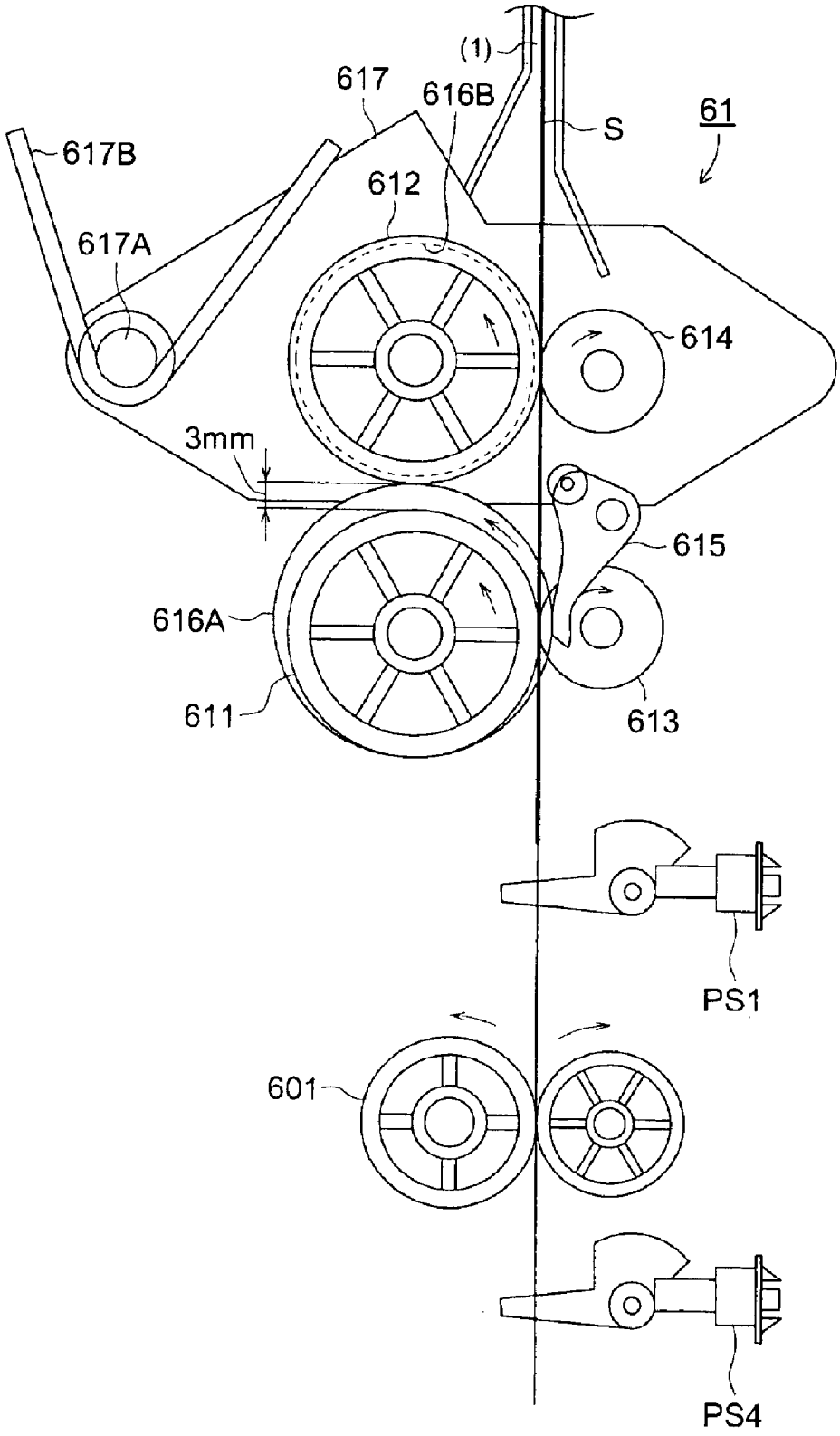
FIG. 4 is a front view showing how a paper passes through the first folding section and a transport path.

FIG. 4 is a front view showing how paper S passes through the first folding section 61 and transport path (1). An explanation of the symbols for reference will be omitted here.

Before paper S transported from inlet roller 601 passes through the first folding section 61, disc-shaped opening/closing cam 616A arranged to be coaxial with folding roller 611 is rotated by a paired folding rollers switching drive means shown in FIG. 7 described later, so that pressure contact and releasing between folding roller 611 and folding roller 612 are conducted. The cam 616A is made of polyacetal resin (POM) and has a cam form that is symmetrical at 180° (line symmetry about an axis).

Folding roller 612, disc-shaped roller 616 representing a pressure contact member arranged to be coaxial with the folding roller 612 and fold-transporting roller 614 are supported rotatably on swinging plate 617. The swinging plate 617 is supported rotatably on supporting shaft 617A and is urged in one direction by spring 617B.

Owing to urging by the spring, an outer circumferential surface of the folding roller 612 is brought into pressure contact with an outer circumferential surface of folding roller 611, and opening/closing cam 616A is brought into pressure contact with roller 616B under the prescribed load. When the cam 616A is rotated counterclockwise by an amount equivalent to 180° so that a distance from a supporting shaft (described later) of the cam 616A turns out to be maximum, the folding roller 611 and the folding roller 612 are kept at the positions where the distance between the folding roller 611 and the folding roller 612 is maximum. In the embodiment, the distance is about 3 mm.

On the back side of fold-transporting roller 613, there is provided an unillustrated spring urging means which keeps the fold-transporting roller 613 to be in pressure contact with the folding roller 611 under the prescribed load. Also on the back side of fold-transporting roller 614, there is provided an unillustrated spring urging means which keeps the fold-transporting roller 614 to be in pressure contact with the folding roller 612 under the prescribed load.

Folding rollers 611 and 612 are rotated counterclockwise as shown by arrows in the drawing by a paper transport driving means shown in FIG. 6(*a*) described later, and fold-transporting rollers 613 and 614 are also rotated clockwise as shown by arrows in the drawing by a paper transport driving means.

Paper S transported to a straight paper transport path of the first folding section 61 is nipped between the folding roller 611 and fold-transporting roller 613 and between the folding roller 612 and fold-transporting roller 614 respectively to be transported straight.

Figure 5:
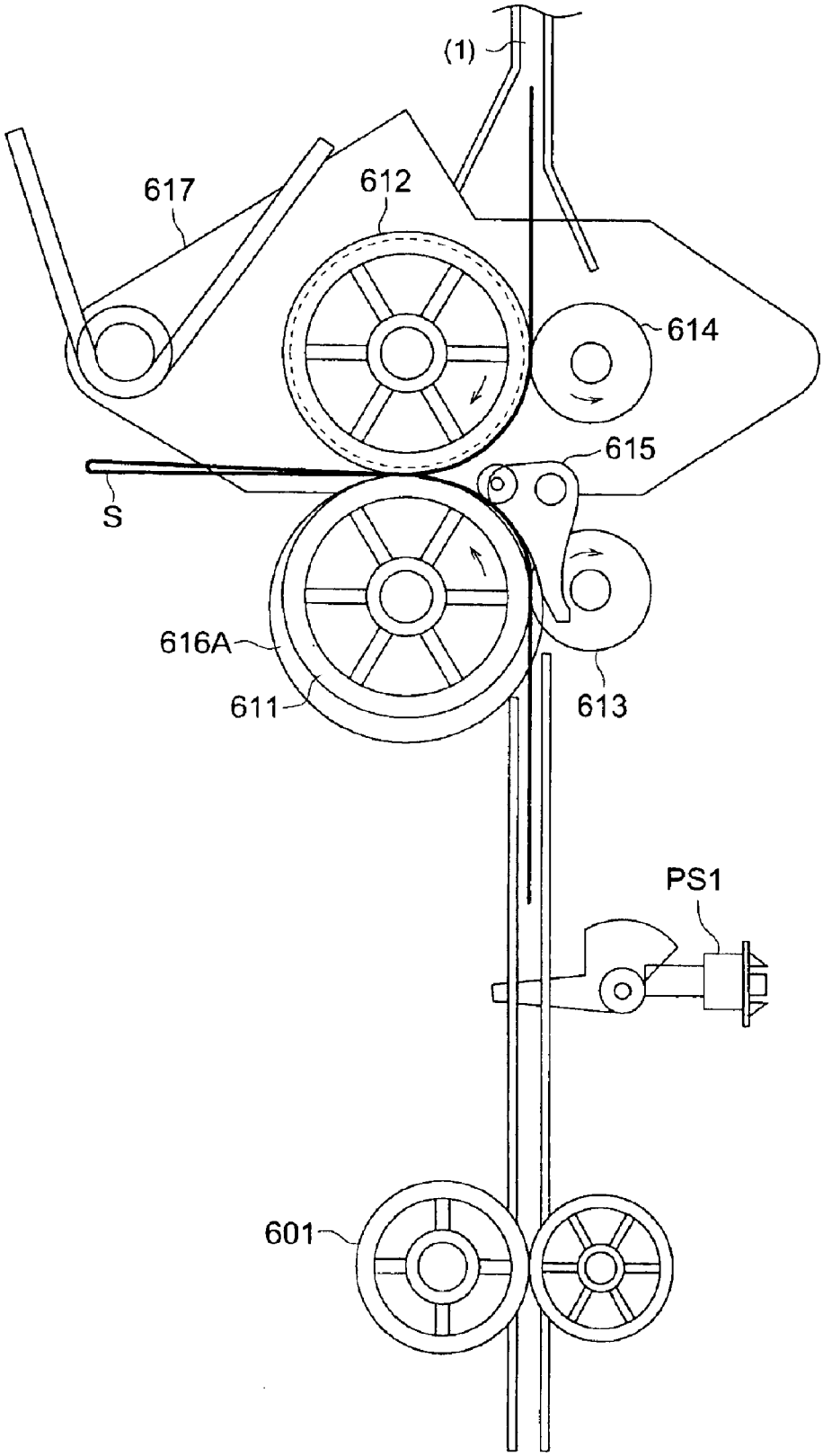
FIG. 5 is a front view showing how a paper is folded by the first folding section.

FIG. 5 is a front view showing how paper S is folded by the first folding section 61.

Paper S whose leading edge has been detected by paper detection sensor PS1 is transported to transport path (1), and after prescribed number of pulses are counted, an unillustrated control means stops the paper S at the prescribed position. This position for the paper S to stop is determined by a paper size an by establishment of selection for folding processing.

After the paper S stops, opening/closing cam 616A is rotated clockwise by an amount equivalent to 180° by a paired folding rollers switching drive means shown in FIG. 7 described later, and when the position of interposing where a distance from a supporting shaft of the cam 616A turns out to be minimum arrives, the folding roller 611 and the folding roller 612 are kept to be in pressure contact.

Then, after a paper transport driving means shown in FIG. 6(*b*) described later is switched, the folding rollers 611 and 612 are rotated to be in opposite direction each other, and the changeover stated above makes fold-transporting rollers 613 and 614 to be driven to rotate in opposite directions each other.

Immediately before the foregoing, guide member 615 is rotated from the standby position that enables paper S to pass to transport path (1) to the position where the guide member touches folding roller 611.

A portion on the downstream side in the paper transport direction on the paper S nipped between folding roller 611 and fold-transporting roller 613 and a portion on the upstream side in the paper transport direction on the paper S nipped between folding roller 612 and fold-transporting roller 614 are pushed in the position of interposing by folding rollers 611 and 612 to be folded, and the paper S is ejected, with its crease facing front, in the direction perpendicular to the transport path (1).

Figure 6:
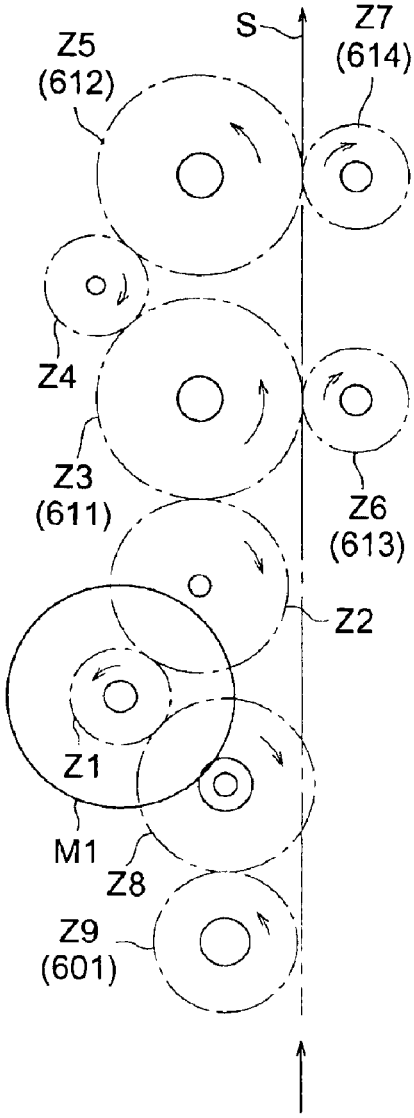
FIGS. 6(*a*) and 6(*b*) are front views of a paper transport driving means respectively for the condition wherein a paper is introduced into the first folding section to advance straight and for the condition wherein a paper is folded.
Figure 6:
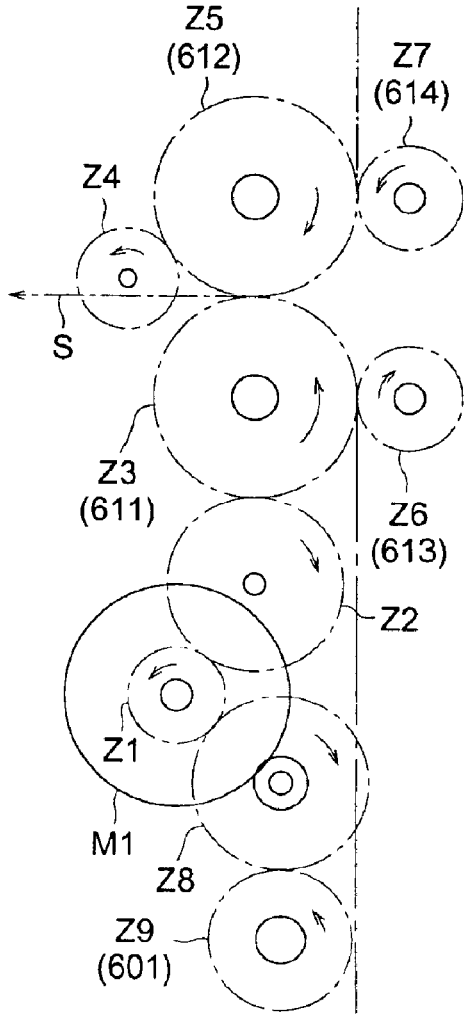

FIG. 6(*a*) is a front view of a paper transport driving means for the condition wherein paper S is introduced into the first folding section 61.

The paper transport driving means for transporting paper S of the first folding section 61 is arranged on a frame plate on the back side which will be described later of post-processing device B. The frame plate is represented, for example, by two metal plates which are arranged vertically to interpose with a front surface side and a rear surface side in the longitudinal direction of rollers to support folding roller 611 and fold-transporting roller 613 rotatably.

Gear Z1 fixed on a rotary shaft of motor M1 is rotated so that folding roller 611 fixed on a rotary shaft of gear Z3 may be rotated counterclockwise in the drawing, and gear Z3 is rotated so that folding roller 612 fixed on a rotary shaft of gear Z5 may be rotated counterclockwise in the drawing. Further, gear Z3 rotates fold-transporting roller 613 fixed on a rotary shaft of gear Z6 clockwise in the drawing, and gear Z5 rotates fold-transporting roller 614 fixed on a rotary shaft of gear Z7 clockwise in the drawing. As a result, paper S can be made to go straight upward as shown with an arrow.

FIG. 6(*b*) is a front view of a paper transport driving means wherein paper S is folded in the first folding section 61.

In the course of paper fold processing, idler gear Z4 is swung on the rotary shaft of gear Z5 serving as a center, by a regular and reverse rotation changeover driving means of a pair of folding rollers shown in FIG. 8(*b*) described later, and engagement with gear Z3 is canceled. Due to this, the gear Z3 engages directly with gear Z5 and rotates folding roller 612 fixed on a rotary shaft of the gear Z5 clockwise in the drawing. Simultaneously with this, gear Z7 engaging with the gear Z5 rotates fold-transporting roller 614 counterclockwise in the drawing. As a result of the foregoing, paper S is nipped to be folded and is transported in the direction of an arrow perpendicular to the paper advancing direction.

Figure 7:
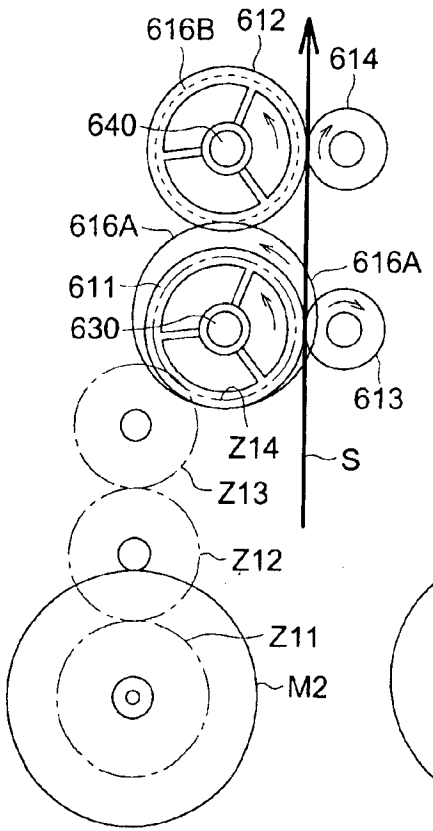
FIGS. 7(*a*)–7(*c*) respectively show front views and a side view of a changeover driving means of a pair of folding rollers.
Figure 7:
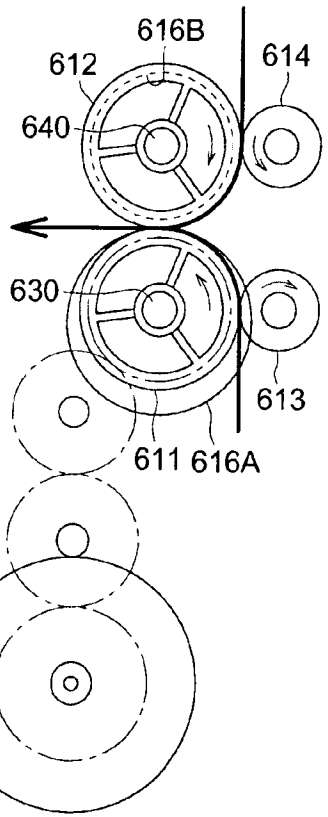
Figure 7:
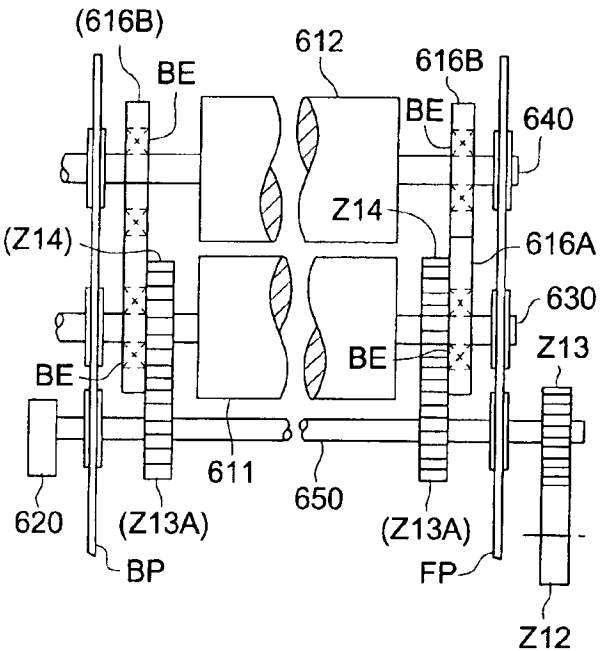

FIG. 7 shows a front view and a side view of a changeover driving means that brings a pair of folding rollers into pressure contact and releases them, and FIG. 7(*a*) shows a front view of how to introduce paper S in the first folding section 61 and to make it to advance straight, while, FIG. 7(*c*) shows its left side view.

The paired folding rollers changeover driving means composed of folding roller 611 and folding roller 612 is arranged on frame plate FP on the front side of post-processing device B shown with a drawing on the left side.

The aforementioned paired rollers changeover driving means is composed of a driving source, a gear train representing a transmission means for the driving source, opening/closing cam 616A and roller 616B.

With respect to a rotation of gear Z11 constituting a gear train that is fixed on a rotary shaft of motor M2 representing a driving source, it rotates opening/closing cam 616A arranged on supporting shaft 630 of gear Z14 in the counterclockwise direction shown with an arrow. During this counterclockwise rotation of the opening/closing cam 616A, when there comes a condition wherein the cam comes in contact with roller 616B at the position where a distance from supporting shaft 630 for the opening/closing cam 616A is maximum, the roller 616B is pushed up and folding roller 612 fixed on supporting shaft 640 of the roller 616B is separated from folding roller 611.

The opening/closing cam 616A and gear Z14 which make it possible for folding rollers 611 and 612 to be brought into pressure contact each other and to be separated each other are mounted on supporting shaft 630 of the folding roller 611 on the upstream side to be rotatable freely through bearing BE that is a rotary member for the supporting shaft 630.

FIG. 7(*b*) is a front view showing how paper S is folded in the first folding section 61.

By rotating the opening/closing cam 616A in the clockwise direction, when there comes a condition wherein the cam comes in contact with roller 616B at the position where a distance from supporting shaft 630 for the opening/closing cam 616A is minimum, the roller 616B is lowered and folding roller 612 fixed on the shaft of the roller 616B is brought into pressure contact with folding roller 611.

The roller 616B is mounted on supporting shaft 640 of the folding roller 612 on the downstream side to be rotatable freely through bearing BE that is a rotary member for the supporting shaft 640.

The symbol BP illustrated in the drawing on the left side represents a frame plate arranged on the back side, and the numeral 620 represents a driving changeover cam which is driven simultaneously with opening/closing cam 616A.

Roller 616B, opening/closing cam 616A, gear Z14 and gear Z13A are also arranged at symmetrical positions on frame plates in front and in the rear. The number of teeth of Z13A is the same as that of Z13.

Figure 8:
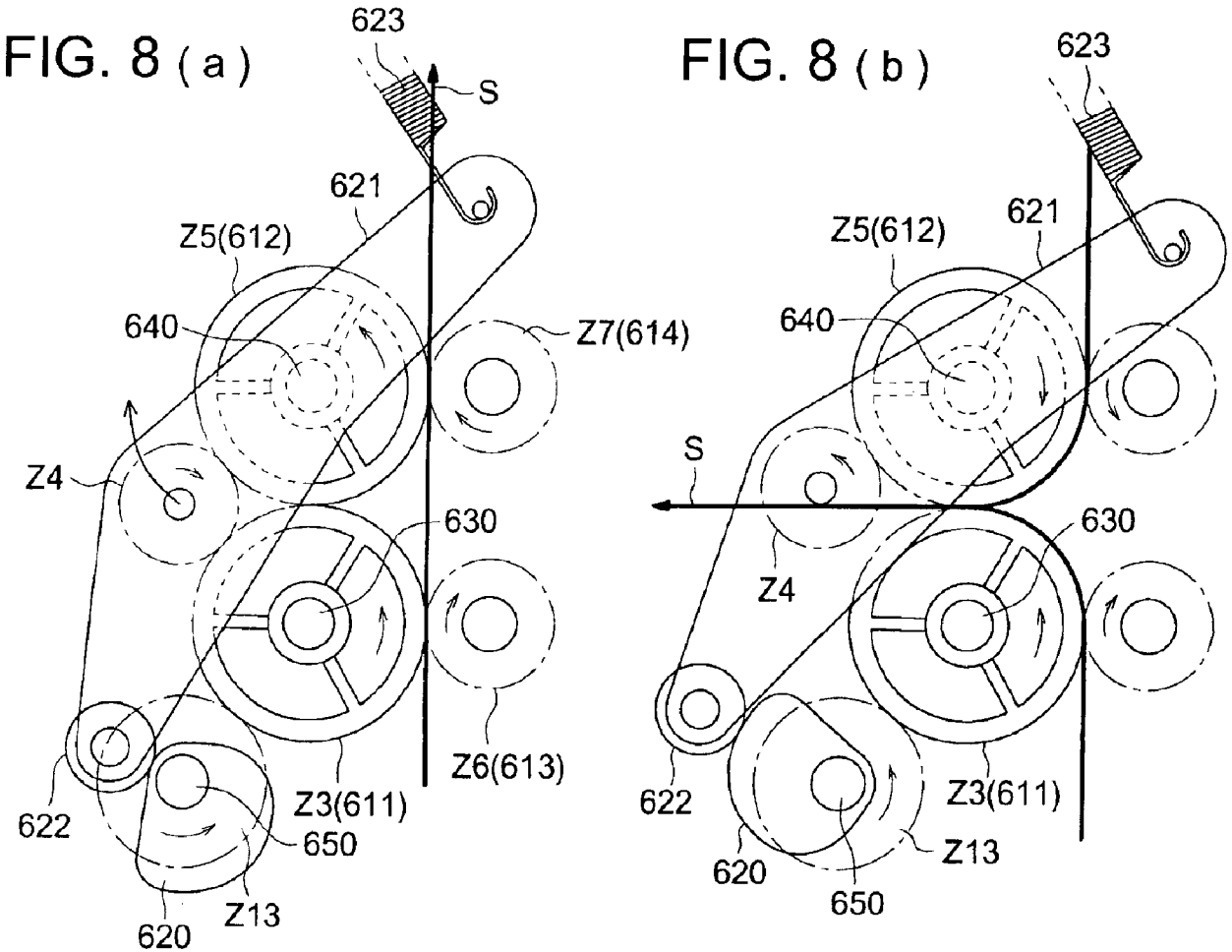
FIGS. 8(*a*) and 8(*b*) are front views of a regular and reverse rotation changeover driving means of a pair of folding rollers.

FIG. 8 shows front views each being of a regular and reverse rotation changeover driving means for a pair of folding rollers, and FIG. 8(*a*) is a diagram showing how paper S is introduced in the first folding section 61 to advance straight.

On the back side of post-processing device B, there is fixed driving changeover cam 620 on an extension line of rotary shaft 650 on which gear Z13 shown in FIG. 7 is fixed.

The cam 620 is in pressure contact with roller 622 which is supported rotatably on an end portion on one side of swingable lever 621.

On the intermediate portion of the lever 621, there is supported idler gear Z4 to be rotatable.

Spring 623 hooked on an end portion on the other side of the lever 621 urges roller 622 to be brought into pressure contact with a cam surface of the driving changeover cam 620. Under the condition that the cam surface of the cam 620 is in contact with roller 622 at the position where a distance from rotary shaft 650 is minimum, the gear Z4 engages with gear Z3 and gear Z5 to rotate folding rollers 611 and 612 in the illustrated counterclockwise direction so that paper S is transported in the direction of going straight.

FIG. 8(*b*) is a diagram showing how paper S is folded in the first folding section 61.

Under the condition that a rotation of driving changeover cam 620 makes roller 622 to touch the position where a distance for the cam surface from rotary shaft 650 is maximum, idler gear Z4 is separated from gear Z3, and driving of opening/closing cam 616A (see FIG. 7) makes the gear Z3 to engage with gear Z5 to rotate folding roller 612 in the illustrated clockwise direction so that paper S may be bent toward the roller side to be folded and transported in the direction of an arrow perpendicular to the direction for a paper to go straight.

FIG. 9 is a diagram showing curve characteristic and its lift amount for opening/closing cam 616A.

Y-axis representing the axis of ordinates in the drawing shows an amount of lift of opening/closing cam 616A, and it shows a separated distance between the aforementioned folding rollers. X-axis shown with the axis of abscissas shows an angle of rotation of the opening/closing cam 616A.

In the embodiment, an amount of lift is not changed for a range from 0° to 7.5° in terms of an angle of rotation, a slight inclination is given for a range from 7.5° to 42.8°, an inclination for an amount of lift to arrive at the maximum value of 3 mm is given for a range from 42.8° to 172.5° and an amount of lift is not changed but is kept at the maximum amount of lift of 3 mm for a range from 172.5° to 180°.

A curve shape of opening/closing cam 616A for a range from 7.5° to 172.5° is formed to make a linear change, and for a range from 180° to 360°, there is given a curve shape which is symmetrical with that for a range from 0° to 180°. Namely, the curve shape is made to be symmetrical about Y-axis at 180°.

Though the characteristics curve is made to be a cam shape to become a straight line, it is also possible to reduce loads in the case of rotation by forming a cam shape having a sine curve or a cosine curve.

A range from 352.5° to 7.5° in terms of an angle of rotation is represented by the condition where roller 616B and opening/closing cam 616A are in contact each other until paper S is detected by paper introduction sensor PS4. Namely, it is a range of an angle in which folding roller 611 is in pressure contact with folding roller 612.

A range from 7.5° to 172.5° is an angular range wherein opening/closing cam 616A is rotated based on results of the detection by the paper introduction sensor PS4 to make it possible to transport paper S, and the folding roller 611 and the folding roller 612 arrive at the maximum separated distance of 3 mm, while, a range from 172.5° to 180° is an angular range wherein paper S is transported to the prescribed position in transport path (1).

A range from 187.5° to 352.5° is an angular range for returning to the initial position for accepting the following paper S.

FIG. 10 is a diagram showing schematically first folding section 61 provided with roller 616B that operates to follow opening/closing cam 616A and assist roller 618A arranged to be symmetrical with the roller 616B regarding with the cam 616A.

On the upstream side of opening/closing cam 616A with which the roller 616B is in pressure contact in the paper transport direction, there is arranged assist roller 618A which can rotate freely on supporting shaft 660 through a rotation member. Further, the assist roller 618A is urged by spring 618B to press the opening/closing cam 616A with a prescribed load from the upstream side.

Accordingly, roller 616B that is coaxial with supporting shaft 640 of folding roller 612 is in pressure contact with an opening/closing cam surface on the downstream side, and assist roller 618A is in pressure contact with the opening/closing cam surface on the upstream side, and therefore, a torque applied on the opening/closing cam 616A from the roller 616B and a moment applied on supporting shaft 630 offset each other to act so that a torque on the opening/closing cam 616A may be balanced. Operations will be explained next.

(1) Opening/closing cam 616A and driving changeover cam 620 are driven simultaneously by a paired folding rollers changeover driving means, and idler gear Z4 is inserted between folding roller 611 and folding roller 612 while separating these rollers.

(2) In this case, Opening/closing cam 616A is subjected to a torque from roller 616B and supporting shaft 630 of the opening/closing cam 616A is subjected to the moment by a pressure contact force. However, loads for driving the opening/closing cam 616A are lightened because a torque in the opposite direction by assist roller 618A that is arranged at the position symmetrical about the supporting shaft 630 of folding roller 611 and actions of moment operate on the opening/closing cam 616A. Then, after two folding rollers 611 and 612 are positionally changed to create the maximum distance of separation, paper S is transported to the prescribed position on transport path (1).

(3) Next, when the paired folding rollers changeover driving means is driven reversely (clockwise rotation), the opening/closing cam 616A and driving changeover cam 620 are driven simultaneously to make both folding rollers 611 and 612 to be in contact with each other and to move idler gear Z4 to a retreated position.

(4) Even in the case of this reversed driving, the opening/closing cam 616A is subjected to a torque from roller 616B and to actions of moment. However, loads for driving the opening/closing cam 616A are lightened because of actions in the opposite direction from assist roller 618A. Thus, the paper S is folded between the paired folding rollers 611 and 612.

In the example of the invention, for conducting pressure contact and separation for the paired folding rollers, a plurality of folding sections were made to be compact to achieve space saving, and further, for reducing loads coming from the roller arranged on a portion on one side of the opening/closing cam for conducting pressure contact and separation for the paired folding rollers, an assist roller was provided on the symmetrical position of the opening/closing cam to balance the load that is exerted when the opening/closing cam is driven, and thereby, loads for driving were reduced. As a result, the driving motor to be provided turned out to be of a small capacity and of a small type, resulting in further space saving.

Embodiment—2

A paper post-processing device to be provided on an image recording apparatus will be explained as follows, referring to FIG. 14 or FIGS. 15(*a*)–15(*c*). Incidentally, FIG. 14 is a sectional view showing primary sections of paper post-processing device B and a recording paper transport path, and FIGS. 15(*a*)–15(*c*) are diagrams each showing each roller member and guide member provided on each of the first-third fold processing sections of the paper post-processing device B in FIG. 14.

Paper post-Processing Device

Figure 14:
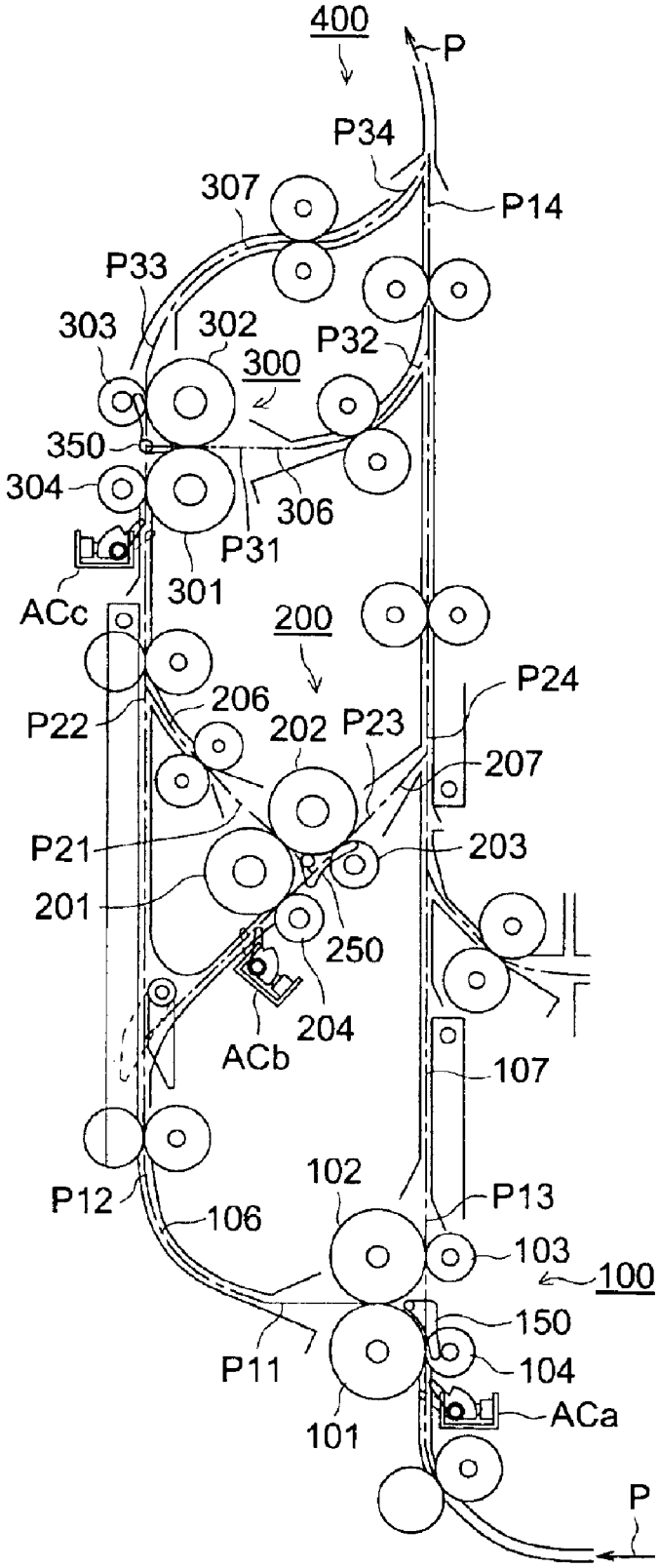
FIG. 14 is a sectional view showing primary sections of paper post-processing device B and a recording paper transport path.

As shown in FIG. 14, paper post-processing device B is provided with the first fold-processing section 100, the second folding section 200 and the third folding section 300, and recording paper P transported from the above-mentioned image forming apparatus A is subjected to at least one of Z fold, outside three fold, inside three fold, double parallel fold, inside fourth fold, outside center fold and inside center fold which will be described later, by the first fold-processing section 100, the second folding section 200 and the third folding section 300. On the paper post-processing device B, there are provided paper transport paths through which the recording paper P is transported in the first fold-processing section 100, the second folding section 200 and the third folding section 300 in the paper post-processing device B. As a paper transport path to be provided, there are given first transport path 106, bypass path 107, second transport path 206, bypass path 207, third transport path 306 and bypass path 307 which will be described later. Incidentally, as shown in the drawing, the direction in which the recording paper P is folded in each of the first fold-processing section 100 and the second folding section 200 is opposite to the direction in which the recording paper P is folded in the third folding section 300.

The recording paper P which has been subjected to the folding processing such as Z fold, outside three fold, inside three fold, double parallel fold, inside fourth fold, outside center fold or inside center fold in the paper post-processing device B is ejected to paper ejection tray 400 from the paper post-processing device B. Further, actuators ACa, ACb and ACc each serving as a paper detection sensor that detects a passage of the leading edge of the recording paper P carried in are provided in the vicinity respectively of the first fold-processing section 100, the second folding section 200 and the third folding section 300.

First Fold-processing Section

As shown in FIG. 14, first fold-processing section 100 is composed of upstream side folding roller 101 serving as a paper transport means, downstream side folding roller 102, downstream side fold-transporting roller 103, upstream side fold-transporting roller 104 and guide member 150 serving as a first guide means. The upstream side folding roller 101, downstream side folding roller 102, downstream side fold-transporting roller 103 and upstream side fold-transporting roller 104 are rotated by the same driving source.

On the first fold-processing section 100, there are provided the first transport path 106 starting from point P11 where folded recording paper P is transported (in the case of center fold described later, the paper is transported without being folded), and ending at point P12, and bypass path 107 starting from point P13 where recording paper P is transported without being folded, and ending at point P14.

As shown in FIG. 15(*a*), guide member 150 having guide surface GP1 is provided rotatably on the center of rotation represented by rotary shaft 104*a* of upstream side fold-transporting roller 104. In the case of fold-processing in the first fold-processing section 100, upstream side folding roller 101 and downstream side folding roller 102 (shown with solid lines) are made to be in contact with each other, and nip point Na is formed between the upstream side folding roller 101 and the downstream side folding roller 102. In this case, the guide member 150 is rotated on the center of rotation represented by rotary shaft 104*a* of the upstream side fold-transporting roller 104, to the guide position shown with solid lines. Further, in the case of paper feeding in the first fold-processing section 100, the downstream side folding roller 102 is separated from the upstream side folding roller 101 to be in the separation state (retreated state) shown with dotted lines, and the guide member 150 is rotated on the center of rotation represented by rotary shaft 104*a* of the upstream side fold-transporting roller 104, to the retreated position shown with dotted lines.

In the case of fold-processing in the first fold-processing section 100, downstream side folding roller 102 (shown with dotted lines) to be separated and upstream side folding roller 101 are rotated by an unillustrated driving source in the opposite direction for nip point Na, as shown by an arrow in dotted lines, and recording paper P shown with solid lines passes through guide surface GP1 of guide member 150 representing a retreated position shown with dotted lines, and downstream side folding roller 102 is brought into contact with upstream side folding roller 101, when the leading edge of recording paper P makes actuator ACa (see FIG. 14, not illustrated in FIG. 15(*a*)) to be "on" and covers a prescribed distance detected by actuator ACa which is dependent on a size of the recording paper P (namely, when the recording paper P advances by several steps after the actuator ACa is made to be "on"). Simultaneously with this, the guide member 150 is rotated on the center of rotation represented by rotary shaft 104*a*, to the guide position shown with solid lines.

Then, the downstream side folding roller 102 and the upstream side folding roller 101 which are made to be in contact with each other are rotated in the same direction for nip point Na as shown with an arrow in solid lines, by an unillustrated driving source, and recording paper P to be transported to the first fold-processing section 100 shown with an arrow in solid lines passes through the guide surface GP1 of the guide member 150 shown with solid lines and through nip point Na, to be transported to the first transport path 106 as shown with an arrow in dotted lines.

In the case of paper feeding without being folded in the first fold-processing section 100, the downstream side folding roller 102 (shown with dotted lines) and the upstream side folding roller 101 which are to be separated are rotated by an unillustrated driving source in the opposite direction for nip point Na, as shown with an arrow in dotted lines, and recording paper P to be transported to the first fold-processing section 100 shown with an arrow in solid lines passes through guide surface GP1 of the guide member 150 shown with dotted lines, to be transported to bypass path 107 as shown with an arrow in one-dot chain lines.

Second Fold-processing Section

As shown in FIG. 14, second fold-processing section 200 is composed of upstream side folding roller 201 serving as a paper transport means, downstream side folding roller 202, downstream side fold-transporting roller 203, upstream side fold-transporting roller 204 and guide member 250 serving as a second guide means. The upstream side folding roller 201, downstream side folding roller 202, downstream side fold-transporting roller 203 and upstream side fold-transporting roller 204 are rotated by the same driving source.

On the second fold-processing section 200, there are provided the second transport path 206 starting from point P21 where folded recording paper P is transported, and ending at point P22, and bypass path 207 starting from point P23 where recording paper P is transported without being folded, and ending at point P24.

As shown in FIG. 15(*b*), guide member 250 having guide surface GP2 is provided rotatably on the center of rotation represented by rotary shaft 203*a* of downstream side fold-transporting roller 203. In the case of fold-processing in the second fold-processing 200, upstream side folding roller 201 (shown with solid lines) and downstream side folding roller 202 are made to be in contact with each other, and nip point Nb is formed between the upstream side folding roller 201 and the downstream side folding roller 202. In this case, the guide member 250 is rotated on the center of rotation represented by rotary shaft 203*a* of the downstream side fold-transporting roller 203, to the guide position shown with solid lines. Further, in the case of paper feeding in the second fold-processing section 200, the upstream side folding roller 201 is separated from the downstream side folding roller 202 to be in the separation state (retreated state) shown with dotted lines, and the guide member 250 is rotated on the center of rotation represented by rotary shaft 203*a* of the downstream side fold-transporting roller 203, to the retreated position shown with dotted lines.

In the case of fold-processing in the second fold-processing section 200, upstream side folding roller 201 (shown with dotted lines) to be separated first and downstream side folding roller 202 are rotated by an unillustrated driving source in the opposite direction for nip point Nb, as shown by an arrow in dotted lines, and recording paper P shown with solid lines passes through guide surface GP2 of guide member 250 representing a retreated position shown with dotted lines, and upstream side folding roller 201 is brought into contact with downstream side folding roller 102, when the leading edge of recording paper P makes actuator ACb (see FIG. 14, not illustrated in FIG. 15 (*b*)) to be "on" and covers a prescribed distance detected by actuator ACb which is dependent on a size of the recording paper P (when the recording paper P advances by several steps after the actuator ACb is made to be "on"). Simultaneously with this, the guide member 250 is made to be in the guide position shown with solid lines.

Then, the upstream side folding roller 201 and the downstream side folding roller 202 which are made to be in contact with each other are rotated in the same direction for nip point Nb as shown with an arrow in solid lines, by an unillustrated driving source, and recording paper P to be transported to the second fold-processing section 200 shown with an arrow in solid lines passes through the guide surface GP2 of the guide member 250 shown with solid lines and through nip point Nb, to be transported to the second transport path 206 as shown with an arrow in dotted lines.

In the case of paper feeding without being folded in the second fold-processing section 200, the upstream side folding roller 201 (shown with dotted lines) and the downstream side folding roller 202 which are to be separated are rotated by an unillustrated driving source in the opposite direction for nip point Nb, as shown with an arrow in dotted lines, and recording paper P to be transported to the second fold-processing section 200 shown with an arrow in solid lines passes through guide surface GP2 of the guide member 250 shown with dotted lines, to be transported to bypass path 207 as shown with an arrow in one-dot chain lines.

Third Fold-processing Section

As shown in FIG. 14, third fold-processing section 300 is composed of upstream side folding roller 301 serving as a paper transport means, downstream side folding roller 302, downstream side fold-transporting roller 303, upstream side fold-transporting roller 304 and guide member 350 serving as a third guide means. The upstream side folding roller 301, downstream side folding roller 302, downstream side fold-transporting roller 303 and upstream side fold-transporting roller 304 are rotated by the same driving source.

On the third fold-processing section 300, there are provided the third transport path 306 starting from point P31 where folded recording paper P is transported, and ending at point P32, and bypass path 307 starting from point P33 where recording paper P is transported without being folded, and ending at point P34.

As is shown with solid lines in FIG. 15(*c*), guide member 350 having upstream side guide surface GPa and downstream side guide surface GPb is provided to be capable of reciprocating in the direction perpendicular to the transport direction for paper P (movable vertically in FIG. 15(*c*)), in the vicinity of nip point Nc of the third fold-processing section 300, with a guide represented by a sliding member (not shown) composed, for example, of an elongated hole and a pin. In the case of fold-processing in the third fold-processing section 300, upstream side folding roller 301 and downstream side folding roller 302 (shown with solid lines) are made to be in contact with each other, and nip point Nc is formed between the upstream side folding roller 301 and the downstream side folding roller 302. In this case, the guide member 350 is moved to the guide position (lower side in FIG. 15(*c*)) shown with solid lines, with an unillustrated sliding member serving as a guide. Further, in the case of paper feeding in the third fold-processing section 300, the downstream side folding roller 302 is separated from the upstream side folding roller 301 to be in the separation state (retreated state) shown with dotted lines, and the guide member 350 is moved to the retreated position (upper side in FIG. 15(*c*)), with an unillustrated sliding member serving as a guide.

In the case of fold-processing in the third fold-processing section 300, downstream side folding roller 302 (shown with dotted lines) to be separated and upstream side folding roller 301 are rotated by an unillustrated driving source in the opposite direction for nip point Na, as shown by an arrow in dotted lines, and recording paper P shown with solid lines passes through a top face of the leading edge of guide member 350 representing a retreated position shown with dotted lines, and downstream side folding roller 302 is brought into contact with upstream side folding roller 301, when the leading edge of recording paper P makes actuator ACc (see FIG. 14, not illustrated in FIG. 15(*c*)) to be "on" and covers a prescribed distance detected by the actuator ACc which is dependent on a size of the recording paper P (namely, when the recording paper P advances by several steps after the actuator ACc is made to be "on"). Simultaneously with this, the guide member 350 is rotated to the guide shown with solid lines, with an unillustrated sliding member serving as a guide.

Then, the downstream side folding roller 302 and the upstream side folding roller 301 which are made to be in contact with each other are rotated in the same direction for nip point Nc as shown with an arrow in solid lines, by an unillustrated driving source, and recording paper P to be transported to the third fold-processing section 300 shown with an arrow in solid lines passes through the guide surfaces GPa and GPb on both sides which guide the recording paper P on the tip of the guide member 350 shown with solid lines and through nip point Nc, to be transported to the third transport path 306 as shown with an arrow in dotted lines.

In the case of paper feeding in the third fold-processing section 300, the downstream side folding roller 302 (shown with dotted lines) and the upstream side folding roller 301 which are to be separated are rotated by an unillustrated driving source in the opposite direction for nip point Nc, as shown with an arrow in dotted lines, and recording paper P to be transported to the third fold-processing section 300 shown with an arrow in solid lines passes through a top face of the tip of the guide member 350 shown with dotted lines, to be transported to bypass path 307 as shown with an arrow in one-dot chain lines.

(3) Structures for each of the first fold-processing section, the second fold-processing section and the third fold-processing section described above will be explained in greater detail, as follows.

There are provided three fold-processing sections in series, and they are constructed so that positions of folding rollers (upstream side folding roller and downstream side folding roller) at the first and the second fold-processing sections and the position of folding rollers at the third fold-processing section face the other side of the paper transport path.

On each fold-processing section, there is provided a bypass path through which a paper is led to the succeeding processing without being folded. Further, each fold-processing section has two folding rollers (an upstream side folding roller and a downstream side folding roller), and fold-transporting rollers (an upstream side fold-transporting roller and a downstream side fold-transporting roller) are pressed respectively against the folding rollers under the prescribed load and are in contact with the folding rollers. Each of the upstream side folding roller, the downstream side folding roller, the upstream side fold-transporting roller and the downstream side fold-transporting roller is driven by an unillustrated gear for transmission.

Two folding rollers including an upstream side folding roller and a downstream side folding roller are arranged to be pressed each other with a prescribed load by an unillustrated pressing member, and they are driven by a transport-driving means (not shown). The downstream side folding roller is structured so that it can be brought into contact with and can be separated from the upstream side folding roller by an unillustrated releasing cam and a cam driving means. When the upstream side folding roller and the downstream side folding roller are in contact with each other under the prescribed load (folding state), they are driven for transmission respectively by gears (not shown) each being on the back side of each of the upstream side folding roller and the downstream side folding roller. When the upstream side folding roller and the downstream side folding roller are in the state of separation (transporting state) by an unillustrated cam, a drive changeover cam (not shown) is driven by an unillustrated cam driving means, so that an idler gear is inserted between gears (not shown) each being on the back side of each of the upstream side folding roller and the downstream side folding roller, and thereby, the upstream side folding roller and the downstream side folding roller are driven for transmission so that both of them may be rotated in the same direction.

On the upstream side fold-transporting roller of the first fold-processing section, there is mounted a guide member that guides an edge of a paper toward a nip point between the upstream side folding roller and the downstream side folding roller, and it is structured to be rotatable on the center of rotation represented by a rotary shaft of the upstream side fold-transporting roller, and it moves to the position retreated (separated) from the paper transport path and to the guide position. Further, On the downstream side fold-transporting roller of the second fold-processing section, there is mounted a guide member that guides an edge of a paper toward a nip point between the upstream side folding roller and the downstream side folding roller, and it is structured to be rotatable on the center of rotation represented by a rotary shaft of the downstream side fold-transporting roller, and it moves to the position retreated (separated) from the paper transport path and to the guide position.

Between the upstream side fold-transport roller and the downstream side fold-transport roller of the third fold-processing section, there is structured a guide member that guides an edge portion of a paper toward a nip point between the upstream side folding roller and the downstream side folding roller to be capable of conducting translational motion (reciprocating movement), and it moves to the position retreated (separated) from the paper transport path and to the guide position.

(4) Next, fundamental operations of each fold-processing section in the first fold-processing section, the second fold-processing section and the third fold-processing section will be explained.

(4–1) The upstream side folding roller and the downstream side folding roller are separated from each other by an unillustrated cam driving means, and an idler gear (not shown) is inserted between folding roller gears (not shown) provided respectively on the upstream side folding roller and the downstream side folding roller, and a guide means is retreated for standby.

(4–2) A paper is ejected from a main body (or, an unillustrated cover paper inserter).

(4–3) The paper is transported by a paper transport means, and a leading edge of the paper arrives at a paper detection sensor (actuator).

(4–4) The paper is nipped respectively by the upstream side folding roller and the upstream side fold-transporting roller and the downstream side folding roller and the downstream side fold-transporting roller, and passes.

(4–5) Paper transportation is stopped at the position that is away from the paper detection sensor (actuator) by a prescribed distance.

(4–6) The upstream side folding roller and the downstream side folding roller are made to be in pressure contact each other by the cam driving means, and the idler gear is made to be on standby, and a guide means is moved to the guide position.

(4–7) The paper transport means drives a pair of folding rollers represented by the upstream side folding roller and the downstream side folding roller and a pair of fold-transporting rollers represented by the upstream side fold-transporting roller and the downstream side fold-transporting roller, thus, the paper is folded at the prescribed position.

(4–8) The paper is folded and is transported.

(4–9) The upstream side folding roller and the downstream side folding roller are separated by the cam driving means, an idler gear is inserted between folding roller gears provided respectively on the upstream side folding roller and the downstream side folding roller, and the guide means is retreated to be on standby.

(5) Control shown on a block diagram in FIG. 21 and paper post-processing in a paper post-processing device such as Z fold, outside three fold, inside three fold, double parallel fold, inside four fold, outside center fold and inside center fold will be explained, referring to FIGS. 16–21. Incidentally, FIG. 16 indicates diagrams showing folding processing for Z fold in the paper post-processing device, FIG. 17 indicates diagrams showing folding processing for outside three fold in the paper post-processing device, FIG. 18 indicates diagrams showing folding processing for inside three fold and double parallel fold in the paper post-processing device, FIG. 19 indicates diagrams showing folding processing for inside four fold in the paper post-processing device, FIG. 20 indicates diagrams showing folding processing for outside center fold and inside center fold in the paper post-processing device and FIG. 21 is a control block diagram for each folding processing.

(Z Fold);

Z fold will be explained as follows, referring to FIG. 16 or FIG. 21.

Figure 21:
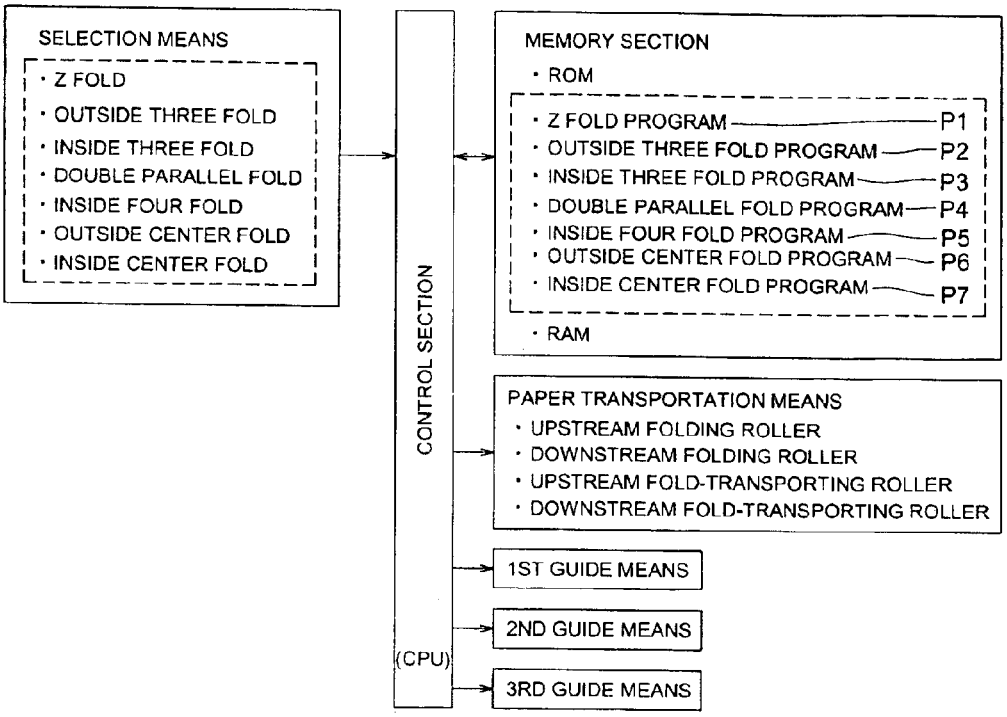
FIG. 21 is a control block diagram for each folding processing.

In FIG. 21, if a mode for Z fold is selected by a selecting means that selects and establishes a paper post-processing mode, the control section outputs Z fold program P1 stored in ROM of the storage section, and drives upstream side folding roller 101 used as a paper transporting means, downstream side folding roller 102, downstream side fold-transporting roller 103, upstream side fold-transporting roller 104 and guide member 150 representing the first guide means (the first fold-processing section 100), as stated in the aforementioned (4), and drives upstream side folding roller 301 used as a paper transporting means, downstream side folding roller 302, downstream side fold-transporting roller 303, upstream side fold-transporting roller 304 and guide member 350 representing the third guide means (the third fold-processing section 300), as stated in the aforementioned (4), to conduct the Z fold.

To be concrete, as shown with arrows in a bold-type in FIG. 16(*a*), recording paper P is transported, with the side of two folding rollers of the first fold-processing section 100 (upstream side folding roller 101 and downstream side folding roller 102) serving as an image surface of the recording paper P and with the trailing edge of the image on the recording paper P serving as a leading edge side (tip portion Pa in FIG. 16(*b*)).

When leading edge portion Pa of recording paper P has advanced on the bottom face of nip point Na by a distance equivalent to about ¼, in the first fold-processing section 100 in FIG. 16(*a*), as shown in (1) of FIG. 16(*b*), the recording paper P is folded with its image surface facing an outer side, by upstream side folding roller 101 and downstream side folding roller 102 of the first fold-processing section 100, as stated in FIG. 15(*a*). The recording paper P in its folded state is transported to the third fold-processing section 300 through the first transport path 106, and when leading edge portion (1) of recording paper P folded has advanced on the top face of nip point Nc by a distance equivalent to about ⅓ as shown on (2) in FIG. 16(*b*), in the third fold-processing section 300 in FIG. 16(*a*), the recording paper P is folded with its image surface facing an inner side, by upstream side folding roller 301 and downstream side folding roller 302 of the third fold-processing section 300, as stated in FIG. 15(*c*), and thus, Z fold shown in FIG. 16(*b*) is conducted. The recording paper P which has been subjected to the Z fold passes through the third transport path 306 shown in FIG. 16(*a*) to be ejected out of the apparatus.

(Outside Three Fold)

Outside three fold will be explained as follows, referring to FIG. 17 or FIG. 21.

When a mode of outside three fold is selected by a selecting means that selects and establishes a paper post-processing mode in FIG. 21, the control section outputs outside three fold program P2 stored in ROM of the storing section, and drives upstream side folding roller 101, downstream side folding roller 102, downstream side fold-transporting roller 103, upstream side fold-transporting roller 104 which are used as a paper transporting means and guide member 150 representing the first guide means (first fold-processing section 100) as stated in (4), and drives upstream side folding roller 201, downstream side folding roller 202, downstream side fold-transporting roller 203 and upstream side fold-transporting roller 204 which are used as a paper transporting means, and guide member 250 representing the second guide means (second fold-processing section 200) as stated in (4), to conduct outside three fold.

To be concrete, as shown with arrows in a bold-type in FIG. 17(*a*), recording paper P is transported, with the side of two folding rollers of the first fold-processing section 100 (upstream side folding roller 101 and downstream side folding roller 102) serving as an image surface of the recording paper P and with the trailing edge of the image on the recording paper P serving as a leading edge side (tip portion Pa in FIG. 17(*b*)).

When leading edge portion Pa of recording paper P has advanced on the bottom face of nip point Na by a distance equivalent to about ⅔, in the first fold-processing section 100 in FIG. 17(*a*), as shown in (1) of FIG. 17(*b*), the recording paper P is folded with its image surface facing an outer side, by upstream side folding roller 101 and downstream side folding roller 102 of the first fold-processing section 100, as stated in FIG. 15(*a*). The recording paper P in its folded state is transported to the second fold-processing section 200 through the first transport path 106, and when leading edge portion Pa of recording paper P folded as shown on (2) in FIG. 17(*b*) has advanced on the bottom face of nip point Nb by a distance equivalent to about ½, in the second fold-processing section 200 in FIG. 17(*a*), the recording paper P is folded with its image surface facing an inner side, by upstream side folding roller 201 and downstream side folding roller 202 of the second fold-processing section 200, as stated in FIG. 15(*b*), and thus, outside three fold shown in FIG. 17(*b*) is conducted. The recording paper P which has been subjected to the outside three fold passes through the third fold-processing section 300 and bypass path 307 shown in FIG. 17(*a*) to be ejected out of the apparatus.

(Inside Three Fold)

Inside three fold will be explained as follows, referring to FIG. 18 or FIG. 21.

When a mode of inside three fold is selected by a selecting means that selects and establishes a paper post-processing mode in FIG. 21, the control section outputs inside three fold program P3 stored in ROM of the storing section, and drives upstream side folding roller 101, downstream side folding roller 102, downstream side fold-transporting roller 103, upstream side fold-transporting roller 104 which are used as a paper transporting means and guide member 150 representing the first guide means (first fold-processing section 100) as stated in (4), and drives upstream side folding roller 201, downstream side folding roller 202, downstream side fold-transporting roller 203 and upstream side fold-transporting roller 204 which are used as a paper transporting means, and guide member 250 representing the second guide means (second fold-processing section 200) as stated in (4), to conduct inside three fold.

Figure 18:
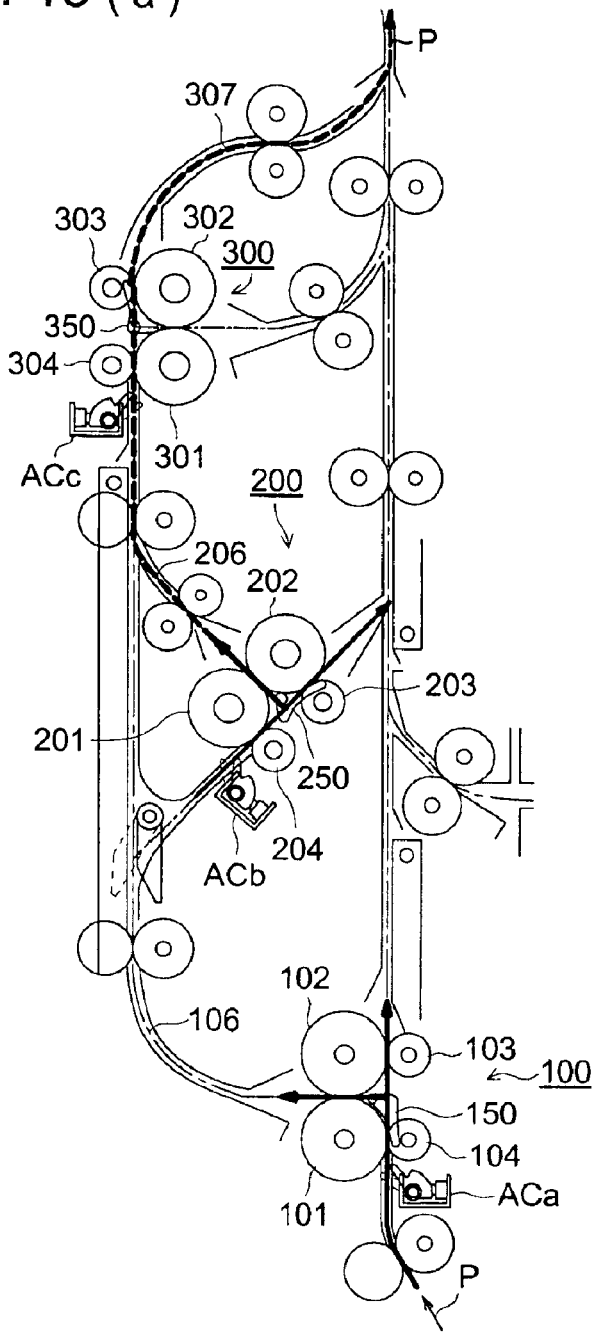
FIGS. 18(*a*)–18(*c*) are diagrams showing folding processing for inside three fold and double parallel fold in the paper post-processing device.
Figure 18:
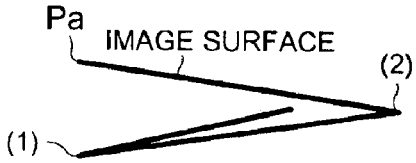
Figure 18:
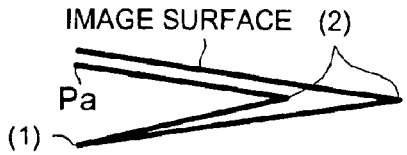

To be concrete, as shown with arrows in a bold-type in FIG. 18(*a*), recording paper P is transported, with the side of two folding rollers of the first fold-processing section 100 (upstream side folding roller 101 and downstream side folding roller 102) serving as an image surface of the recording paper P and with the trailing edge of the image on the recording paper P serving as a leading edge side (tip portion Pa in FIG. 18(*b*)).

When leading edge portion Pa of recording paper P has advanced on the bottom face of nip point Na by a distance equivalent to about ⅔ odd, in the first fold-processing section 100 in FIG. 18(*a*), as shown in (1) of FIG. 18(*b*), the recording paper P is folded with its image surface facing an inner side, by upstream side folding roller 101 and downstream side folding roller 102 of the first fold-processing section 100, as stated in FIG. 15(*a*). The recording paper P in its folded state is transported to the second fold-processing section 200 through the first transport path 106, and when leading edge portion Pa of recording paper P folded as shown on (2) in FIG. 18(*b*) has advanced on the bottom face of nip point Nb by a distance equivalent to about a little under ½, in the second fold-processing section 200 in FIG. 18(*a*), the recording paper P is folded with its image surface facing an outer side, by upstream side folding roller 201 and downstream side folding roller 202 of the second fold-processing section 200, as stated in FIG. 15(*b*), and thus, outside three fold shown in FIG. 18(*b*) is conducted. The recording paper P which has been subjected to the outside three fold passes through the third fold-processing section 300 and bypass path 307 shown in FIG. 18(*a*) to be ejected out of the apparatus.

(Double Parallel Fold)

Double parallel fold will be explained as follows, referring to FIG. 18 or FIG. 21.

When a mode of double parallel fold is selected by a selecting means that selects and establishes a paper post-processing mode in FIG. 21, the control section outputs double parallel fold program P3 stored in ROM of the storing section, and drives upstream side folding roller 101, downstream side folding roller 102, downstream side fold-transporting roller 103, upstream side fold-transporting roller 104 which are used as a paper transporting means and guide member 150 representing the first guide means (first fold-processing section 100) as stated in (4), and drives upstream side folding roller 201, downstream side folding roller 202, downstream side fold-transporting roller 203 and upstream side fold-transporting roller 204 which are used as a paper transporting means, and guide member 250 representing the second guide means (second fold-processing section 200) as stated in (4), to conduct double parallel fold.

To be concrete, as shown with arrows in a bold-type in FIG. 18(*a*), recording paper P is transported, with the side of two folding rollers of the first fold-processing section 100 (upstream side folding roller 101 and downstream side folding roller 102) serving as an image surface of the recording paper P and with the trailing edge of the image on the recording paper P serving as a leading edge side (tip portion Pa in FIG. 18(*c*)).

When leading edge portion Pa of recording paper P has advanced on the bottom face of nip point Na by a distance equivalent to about a little under ½, in the first fold-processing section 100 in FIG. 18(*a*), as shown in (1) of FIG. 18(*c*), the recording paper P is folded with its image surface facing an outer side, by upstream side folding roller 101 and downstream side folding roller 102 of the first fold-processing section 100, as stated in FIG. 15(*a*). The recording paper P in its folded state is transported to the second fold-processing section 200 through the first transport path 106, and when leading edge portion Pa of recording paper P folded as shown on (2) in FIG. 18(*c*) has advanced on the bottom face of nip point Nb by a distance equivalent to about ½, in the second fold-processing section 200 in FIG. 18(*a*), the recording paper P is folded with its image surface facing an inner side, by upstream side folding roller 201 and downstream side folding roller 202 of the second fold-processing section 200, as stated in FIG. 15(*b*), and thus, double parallel fold shown in FIG. 18(*c*) is conducted. The recording paper P which has been subjected to the double parallel fold passes through the third fold-processing section 300 and bypass path 307 shown in FIG. 18(*a*) to be ejected out of the apparatus.

(Inside Four Fold)

Inside four fold will be explained as follows, referring to FIG. 19 or FIG. 21.

When a mode of inside four fold is selected by a selecting means that selects and establishes a paper post-processing mode in FIG. 21, the control section outputs inside four fold program P5 stored in ROM of the storing section, and drives upstream side folding roller 101, downstream side folding roller 102, downstream side fold-transporting roller 103, upstream side fold-transporting roller 104 which are used as a paper transporting means and guide member 150 representing the first guide means (first fold-processing section 100) as stated in (4), then, drives upstream side folding roller 201, downstream side folding roller 202, downstream side fold-transporting roller 203 and upstream side fold-transporting roller 204 which are used as a paper transporting means, and guide member 250 representing the second guide means (second fold-processing section 200) as stated in (4), and further drives upstream side folding roller 301, downstream side folding roller 302, downstream side fold-transporting roller 303 and upstream side fold-transporting roller 304 which are used as a paper transporting means, and guide member 350 representing the third guide means (third fold-processing section 300) as stated in (4), to conduct inside four fold.

To be concrete, as shown with arrows in a bold-type in FIG. 19(*a*), recording paper P is transported, with the side of two folding rollers of the first fold-processing section 100 (upstream side folding roller 101 and downstream side folding roller 102) serving as an image surface of the recording paper P and with the trailing edge of the image on the recording paper P serving as a leading edge side (tip portion Pa in FIG. 19(*b*)).

When leading edge portion Pa of recording paper P has advanced on the bottom face of nip point Na by a distance equivalent to about ¼, in the first fold-processing section 100 in FIG. 19(*a*), as shown in (1) of FIG. 19(*b*), the recording paper P is folded with its image surface facing an outer side, by upstream side folding roller 101 and downstream side folding roller 102 of the first fold-processing section 100, as stated in FIG. 12(*a*). The recording paper P in its folded state is transported to the second fold-processing section 200 through the first transport path 106, and when leading edge portion Pa of recording paper P folded as shown on (2) in FIG. 19(*b*) has advanced on the bottom surface of nip point Nb by a distance equivalent to about ⅔, in the second fold-processing section 200 in FIG. 19(*a*), the recording paper P is folded with its image surface facing an outer side, by upstream side folding roller 201 and downstream side folding roller 202 of the second fold-processing section 200, as stated in FIG. 15(*b*). The recording paper P in its folded state is transported to the third fold-processing section 300 through the second transport path 206, and when leading edge portion Pa of recording paper P folded as shown on (3) in FIG. 19(*b*) has advanced on the top face of nip point Nc by a distance equivalent to about ½, in the third fold-processing section 300 in FIG. 19(*a*), the recording paper P is folded with its image surface facing an outer side, by upstream side folding roller 301, downstream side folding roller 302 of the third fold-processing section 300 and by guide surfaces GPa and GPb on both sides of the tip of guide member 350, as stated in FIG. 15(*c*), and thus, the inside four fold shown in FIG. 19(*b*) is conducted. The recording paper P which has been subjected to the inside four fold passes through bypass path 307 shown in FIG. 19(*a*) to be ejected out of the apparatus.

(Outside Center Fold)

Outside center fold will be explained as follows, referring to FIG. 20 or FIG. 21.

When a mode of outside center fold is selected by a selecting means that selects and establishes a paper post-processing mode in FIG. 21, the control section outputs outside center fold program P6 stored in ROM of the storing section, and drives upstream side folding roller 101, downstream side folding roller 102, downstream side fold-transporting roller 103 and upstream side fold-transporting roller 104 which are used as a paper transporting means and guide member 150 representing the first guide means (first fold-processing section 100) as stated in (4), to conduct the outside center fold.

To be concrete, as shown with arrows in a bold-type in FIG. 20(*a*), recording paper P is transported, with the side of two folding rollers of the first fold-processing section 100 (upstream side folding roller 101 and downstream side folding roller 102) serving as an image surface of the recording paper P and with the trailing edge of the image on the recording paper P serving as a leading edge side (tip portion Pa in FIG. 20(*b*)).

When leading edge portion Pa of recording paper P has advanced on the bottom face of nip point Na by a distance equivalent to about ½, in the first fold-processing section 100 in FIG. 20(*a*), as shown in (1) of FIG. 20(*b*), the recording paper P is folded with its image surface facing an outer side, by upstream side folding roller 101 and downstream side folding roller 102 of the first fold-processing section 100, as stated in FIG. 15(*a*), and thereby, the outside center fold shown in FIG. 20(*b*) is conducted. The recording paper P which has been subjected to the outside center fold passes through the second fold-processing section 200, bypass path 207 and bypass path 107 which are shown in FIG. 20(*a*), to be ejected out of the apparatus.

(Inside Center Fold)

Inside center fold will be explained as follows, referring to FIG. 20 or FIG. 21.

When a mode of inside center fold is selected by a selecting means that selects and establishes a paper post-processing mode in FIG. 21, the control section outputs outside center fold program P7 stored in ROM of the storing section, and drives upstream side folding roller 301, downstream side folding roller 302, downstream side fold-transporting roller 303 and upstream side fold-transporting roller 304 which are used as a paper transporting means and guide member 350 representing the third guide means (third fold-processing section 300) as stated in (4), to conduct the inside center fold.

To be concrete, as shown with arrows in a bold-type in FIG. 20(*a*), recording paper P is transported, with the side of two folding rollers of the first fold-processing section 100 (upstream side folding roller 101 and downstream side folding roller 102) serving as an image surface of the recording paper P and with the trailing edge of the image on the recording paper P serving as a leading edge side (tip portion Pa in FIG. 20(*b*)).

Recording paper P is made to pass through a space between guide member 150 of the first fold-processing section 100 and a space between the upstream side folding roller 101 and the downstream side folding roller 102, without being folded in the first fold-processing section 100, and is transported to the third fold-processing section 300. When leading edge portion Pa of recording paper P has advanced on the top face of nip point Nc by a distance equivalent to about ½, in the third fold-processing section 300, as shown in (1) of FIG. 20(*c*), the recording paper P is folded with its image surface facing an inner side, by upstream side folding roller 301 and downstream side folding roller 302 of the third fold-processing section 300, as stated in FIG. 15(*a*), and thereby, the inside center fold shown in FIG. 20(*c*) is conducted. The recording paper P which has been subjected to the inside center fold passes through bypass path 307 shown in FIG. 20(*a*), to be ejected out of the apparatus.

By employing the structure of the invention as stated above, it is possible to obtain an image recording apparatus equipped with a paper post-processing device wherein space saving is achieved, seven types of folding such as inside center fold, outside center fold, Z fold, inside three fold, outside three fold, double parallel fold and inside four fold can be conducted, and it is not necessary to open again the folded paper for transporting.

Embodiment—3

Embodiment of the invention—3 relating to the invention will be explained in detail as follows, referring to the drawings.

First, the structure of the image forming system will be explained based on the structure diagram in FIG. 22. Incidentally, this is just an example, and any image forming system constituted by an image forming apparatus and a post-processing device in any forms can be included in the category of the invention, provided that punching processing which will be described later can be conducted in the system.

In image forming apparatus 400A, there are provided charging means 402, imagewise exposure means 403, developing means 404, transfer means 405A, neutralizing means 405B, separating claw 405C and cleaning means 406 around rotary image carrier 401, and exposure scanning based on image data obtained from a document through reading by a laser beam of the imagewise exposure means 403 is conducted to form a latent image, after uniform charging is performed on a surface of the image carrier 401 by the charging means 402, and the latent image is subjected to reversal development by the developing means 404 to form a toner image on a surface of the image carrier 401.

Incidentally, an image writing means in features of the invention corresponds to the imagewise exposure means 403, while, an image forming means corresponds to the charging means 402, developing means 404 and transfer means 405A.

On the other hand, image recording paper (hereinafter referred to as a paper) S that is fed from paper feeding means 407 is transported to the transfer position where the toner image is transferred onto the paper S by the transfer means 405A. After that, charges on the reverse side of the paper S are neutralized by the neutralizing means 405B, and the paper S is separated from the image carrier 1 by the separating claw 405C to be transported by intermediate transport section 407B, and is heated and fixed by fixing means 408 to be ejected by paper ejection roller 407C.

Incidentally, when conducting image forming on one side of paper 400S, transport path changeover plate 407D is switched to the state shown with dotted lines.

Further, developing agents remaining on the surface of the image carrier 401 is removed by the cleaning means 406 at the downstream side of the separating claw 405C, to be ready for the succeeding image forming.

On the other hand, when forming images on both sides of paper S, transport path changeover plate 407D is switched to the condition shown with solid lines so that paper S heated and fixed by the fixing means 408 is transported downward, and is reversed inside out on a switchback basis in reversing transport means 407E, and then, a new toner image is transferred on a reverse side at the transfer position. After that, the paper is heated and fixed in the same process as in the foregoing, and is ejected out by the paper ejection roller 407C after passing through the transport path changeover plate 407D that is switched to the condition shown with broken lines.

Further, when conducting punching processing, fold-processing and binding-processing, as described later, transport path changeover plate 407D is switched to the condition shown with solid lines so that paper S heated and fixed by the fixing means 408 is transported downward, and is reversed inside out on a switchback basis in reversing transport means 407E, and is ejected out by the paper ejection roller 407C.

Independently of any condition, the paper S ejected by the paper ejection roller 407C is fed into post-processing device 400FS.

Incidentally, on the upper front side of the image forming apparatus 400A, there is arranged operation section 409 that selects an image forming mode or a paper post-processing mode to establish it, and on the upper portion of the image forming apparatus 400A, there is installed image reading device 400B equipped with an automatic document feeding device of a moving document reading type.

In the post-processing device 400FS, first paper feeding tray 420A, second paper feeding tray 420B and stationary paper feeding tray 491 are arranged on the upper deck in the drawing, punching means 430, shifting means 450 and paper ejecting means 460 are arranged in series on the same plane which is substantially horizontal, on the intermediate deck, and binding means 470 and folding means 480 are arranged in series on the same plane that is inclined, on the lower deck.

Further, on the left portion of the post-processing device 400FS, there are arranged elevating paper ejection tray 492 on which shifted papers S and bound paper bundles are stacked to be elevated or lowered and stationary paper ejection tray 493 on which paper bundles that have been subjected to three fold or two fold are stacked.

Then, paper S ejected from the paper ejection roller 407C of the image forming apparatus 400A is introduced into inlet roller 411 of post-processing device FS. Incidentally, the inlet roller 411 is arranged to agree with the paper ejection roller 407C of the image forming apparatus 400A in terms of a position.

Further, not only paper S ejected from image forming apparatus A but also an inserting paper (interleaf) that is supplied from the first paper feeding tray 420A and is inserted between paper bundles and a paper for a cover that is supplied from the second paper feeding tray 420B and becomes a cover of the bundle of papers, are introduced. An inserting paper is separated and fed by paper-feeding roller 421 and is transported by a plurality of transporting rollers 423 to be introduced into inlet roller 411, and a paper for a cover is separated and fed by paper-feeding roller 422 and is transported by a plurality of transporting rollers 423 to be introduced into inlet roller 411.

On the downstream side of the inlet roller 411 in the transport direction for papers, there is arranged punching means 430, and two to four holes for filing are punched at prescribed positions for each of paper 400S, an inserting paper and a paper for a cover which are transported. Incidentally, since the punching processing by the punching means 430 is the cardinal point of the invention, it will be described in detail separately. Paper S and others which have been subjected to punching processing are transported by transporting rollers 412, 413 and 414 and arrive at a pair of changeover gates 400G.

Changeover gates 400G is branched selectively through driving of an unillustrated solenoid to either one of paper transport paths in three directions including the first transport path F401 leading to stationary paper ejecting tray 491, the second transport path F402 leading to shifting means 450 and the third transport path F403 leading to binding means 470.

Now, when a simple paper ejection is established, the changeover gate 400G opens only the first transport path F401, and closes the second transport path F402 and the third transport path F403. Then, the paper S passes through the first transport path F401 to ascend and is stacked successively on stationary paper ejection tray 491.

When a shift processing is established, the changeover gate 400G opens only the second transport path F402, and closes the first transport path F401 and the third transport path F403. Then, the paper S passes through the second transport path F402 and is shifted by shifting means 450 in the direction perpendicular to the paper transport direction. The shifting means 450 conducts shift processing wherein a paper ejection position for paper S is changed every prescribed number of papers in the lateral direction for paper transport. Shifted papers S are ejected on elevating paper ejection tray 492 to be stacked thereon in succession.

When a binding processing or a folding processing is established, the changeover gate 400G opens only the third transport path F403, and closes the first transport path F401 and the second transport path F402. Then, the paper S passes through the third transport path F403, and the leading edge portion of the paper S hits and is stopped in the vicinity of a interposing position of a pair of inlet transport rollers (registration rollers) 471 so that leading edges of papers are trued up. After the trailing edge of paper S in its advancing direction is ejected from the interposing position of the paired inlet transport rollers, the paper S is lifted upward along paper stacking tray 472 by inertial force, and then, is changed by its own weight to descending to slide and descend on an inclined surface of the paper stacking tray 472, and stops.

When prescribed number of papers S (paper bundles) are stacked on the paper stacking tray 472, the papers are regulated by unillustrated paired width-regulating members provided on both sides of the paper stacking tray 472, and then, binding means 470 drives in one or two staples at one location or two locations in the vicinity of a side edge of a paper bundle, for binding processing. The bound paper bundle slides on a bottom surface of the paper stacking tray 472, and is pushed upward obliquely and is ejected and stacked on elevating paper ejection tray 492.

Incidentally, though it is possible for the second fold-processing means 480 to conduct two fold-processing and three fold-processing, explanation thereof will be omitted.

Next, mechanisms of punching processing relating to the invention will be explained as follows, referring to FIGS. 23 and 24.

First, structures of punching processing mechanism will be explained as follows, referring to FIGS. 23 and 24. FIG.

Figure 24:
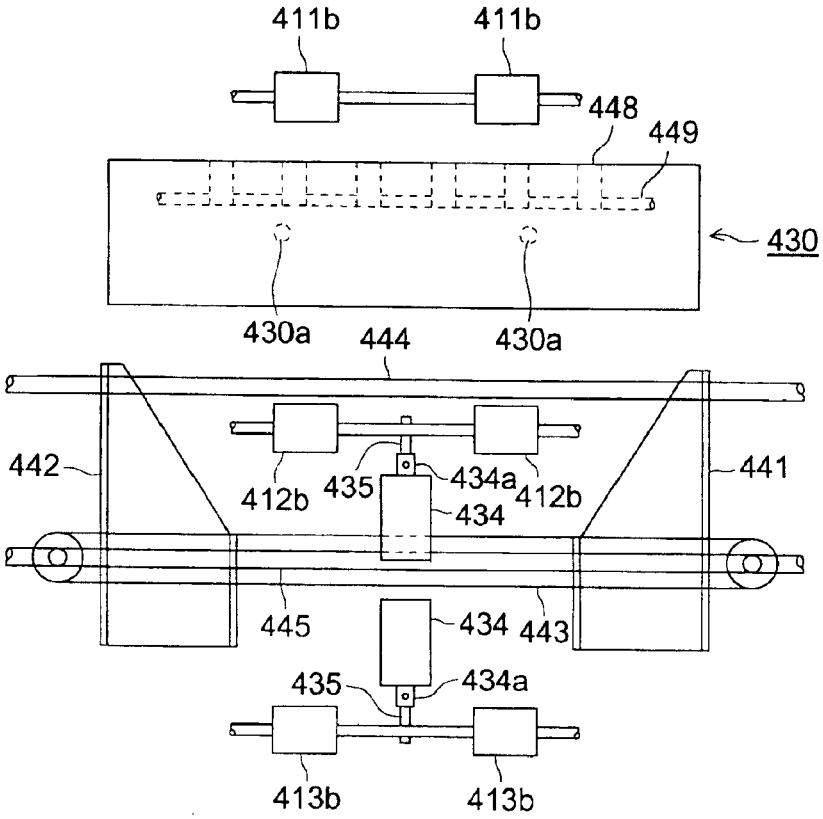
FIG. 24 is a top view of primary portions in a punching processing mechanism.

23 is a side view of primary portions in a punching processing mechanism, and FIG. 24 is a top view of primary portions in a punching processing mechanism.

Figure 22:
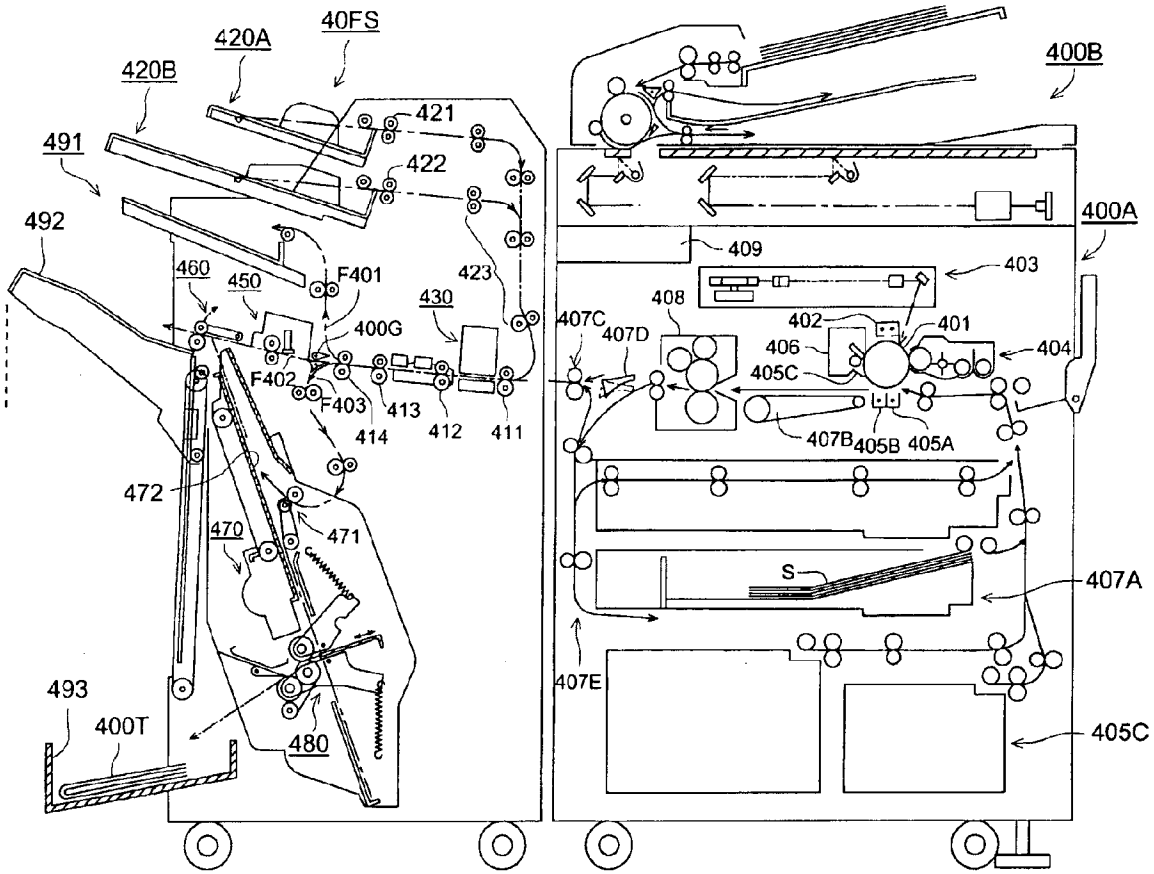
FIG. 22 is a structure diagram of an image forming system.

In both drawings, inlet roller 411, transporting rollers 412 and 413 and punching means 430 are the same as those shown in FIG. 22. Inlet roller 411, transporting rollers 412 and 413 are composed respectively of driving rollers 411*a*, 412*a* and 413*a* and respectively of driven rollers 411*b*, 412*b* and 413*b*, and the driving rollers 411*a*, 412*a* and 413*a* are driven by an unillustrated motor. Further, upper guide plate 431 and lower guide plate 432 are arranged so that paper S may be guided and transported surely by transporting rollers 412 and 413. Helical torsion spring 433 is engaged with spring holding section 431*a* provided on upper guide plate 431, and one end of the helical torsion spring 433 presses supporting shafts 412*c* and 413*c* respectively of driven rollers 412*b* and 413*b*. Therefore, the driven rollers 412*b* and 413*b* are in pressure contact with the driving rollers 412*a* and 413*a*. Further, the driven rollers 412*b* and 413*b* are constructed to be released from pressure contact with the driving rollers 412*a* and 413*a* and to be capable of moving upward, and guide section 431*b* that guides supporting shafts 412*c* and 413*c* is provided on upper guide plate 431.

Incidentally, an urging member in features of the invention corresponds to the helical torsion spring 433, but the urging member is not always limited to the helical torsion spring, and it may also be helical spring or a leaf spring for tension or compression. In a word, an urging member of any type can be employed if it can urge in the direction to bring driven rollers 412*b* and 413*b* into pressure contact respectively with driving rollers 412*a* and 413*a*.

Two solenoids 434 are arranged above the upper guide plate 431, and crank lever 435 is provided between each solenoid 434 and each of the driven rollers 412*b* and 413*b*. One end of the crank lever 435 is engaged with plunger 434*a* of each solenoid 434 and the other end of the crank lever 435 is constructed to be capable of pushing up each of supporting shafts 412*c* and 413*c* respectively of driven rollers 412*b* and 413*b* by touching a bottom of each supporting shaft.

There are further provided width-regulating plates 441 and 442 which press end portions on both sides of paper S transported to the position of each of the transporting rollers 412 and 413 toward the center of the paper in the direction in a width of the paper that is perpendicular to the paper transport direction, to eliminate lack of uniformity of papers. The width-regulating plates 441 and 442 are supported respectively by supporting shafts 444 and 445 and can be moved in the paper width direction and in opposite directions each other by belt 443 driven by an unillustrated stepping motor.

Punch 430*a* that punches holes for filing on paper S is provided on punching means 430, and a plurality of stopper members 448 are provided at the upstream side of the punch 430*a* in the paper transport direction. The stopper members 448 are freely rotated by an unillustrated stepping motor on supporting shaft 449, and when the paper S is made to pass through the punching means 430 from the upstream side in the paper transport direction as described later, the stopper members 448 are retreated from transport path 430*b* for paper S, while, when the paper S is transported to the punching means 430 from the downstream side in the paper transport direction, the stopper members 448 are inserted in the transport path 430*b* to be hit by the trailing edge of the paper S.

Incidentally, an actuator that drives the stopper members 448 is not limited to a stepping motor, and a structure wherein a stopper member is inserted in or taken out of the transport path 430*b* may also be employed.

On the upstream side of the punching means 430 in the paper transport direction, there is further arranged sensor 447 that detects paper S.

Next, punching processes will be explained as follows, referring to FIGS. 23–26.

Figure 23:
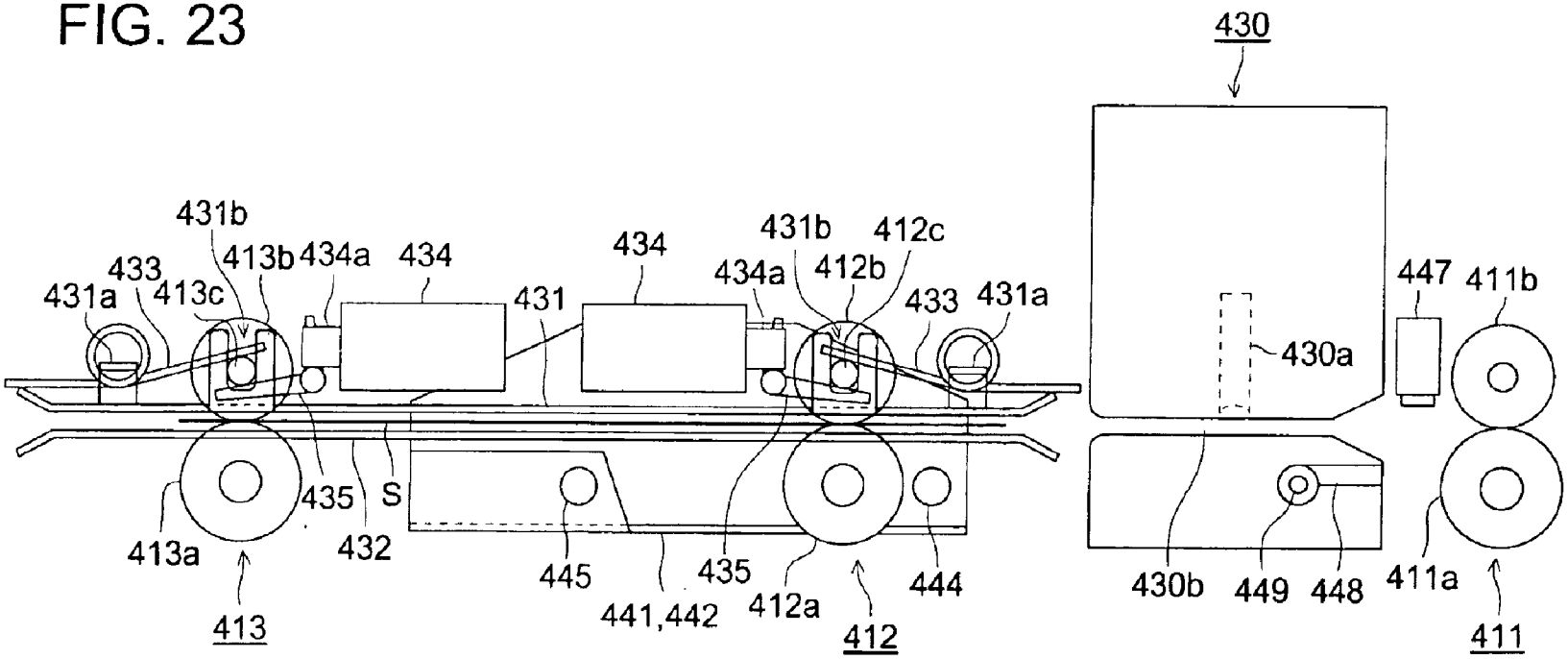
FIG. 23 is a side view of primary portions in a punching processing mechanism in which a paper is fed by a transporting roller.

First, in FIGS. 22 and 23, paper 400S ejected from paper ejection roller 407C of image forming apparatus 400A is fed in inlet roller 411 of post-processing device 400FS, and then is transported to the punching means 430 by the inlet roller 411. In this case, the stopper members 448 are retreated from transport path 430*b* of the punching means 430, and the papers passes through the transport path 430*b* as it is. Then, a leading edge portion of the paper S is transported by transporting roller 412 to a space between upper guide plate 431 and lower guide plate 432, and when sensor 447 detects a trailing edge portion of the paper S, a timer of an unillustrated control means operates to stop rotations of transporting rollers 412 and 413 after a prescribed period of time. In this case, the paper S is nipped by the transporting rollers 412 and 413, and width-regulating plates 441 and 442 are located at positions which are slightly outside the end portions on both sides of the paper S to be away from them. This condition is shown in FIG. 23.

Figure 25:
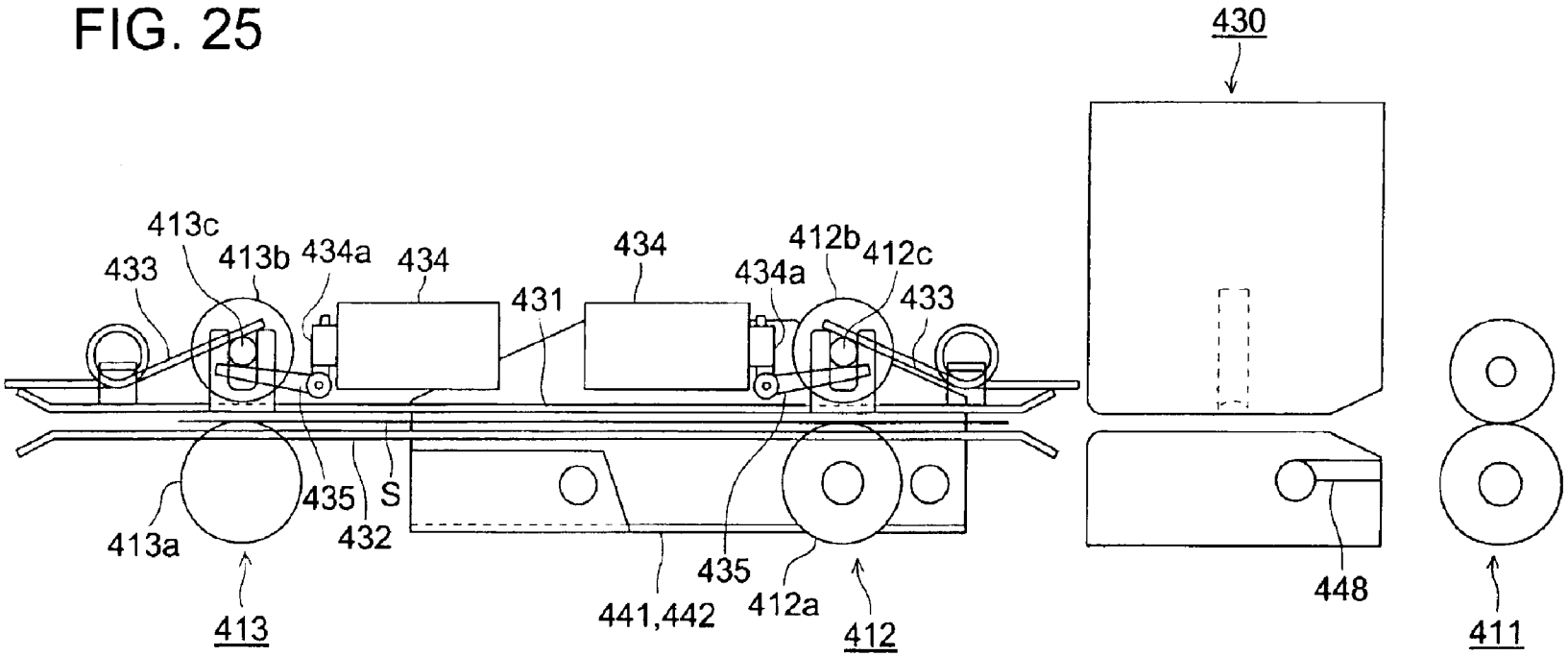
FIG. 25 is a side view of primary portions in a punching processing mechanism in which pressure contact of a driven roller against a driving roller is released.

Next, when the transporting rollers 412 and 413 stop rotating to cause the condition shown in FIG. 23, the control means turns on two solenoids 434, and each plunger 434*a* is drawn in the solenoid 434. Then, both crank levers 435 rotate, and one end of the crank lever 435 presses upward the lower portion of each of supporting shafts 412*c* and 413*c* respectively for driven rollers 412*b* and 413*b*, against the urging force of helical torsion spring 433, thus, pressure contact between the driven roller 412*b* and the driving roller 412*a* and that between the driven roller 413*b* and the driving roller 413*a* are canceled. This condition is shown in FIG. 25.

When pressure contact between the driven roller 412*b* and the driving roller 412*a* and that between the driven roller 413*b* and the driving roller 413*a* are canceled, interposing of paper 400S by each roller is canceled, thus, an unillustrated stepping motor is driven to rotate belt 443, and thereby, width-regulating plates 441 and 442 are moved toward the center to press the end portions on both sides of the paper S for its width regulation.

After completion of the width regulation of paper S, solenoids 434 are turned off. Then, plungers 434*a* project, and one end of crank lever 435 retreats from the lower portion of each of the supporting shafts 412*c* and 413*c* respectively of the driven rollers 412*b* and 413*b*. Thereby, the driven rollers 412*b* and 413*b* are brought into pressure contact respectively with the driving rollers 412*a* and 413*a* again by the urging force of helical torsion spring 433. Namely, the paper S is nipped again by rollers to return to the condition shown in FIG. 23.

Figure 26:
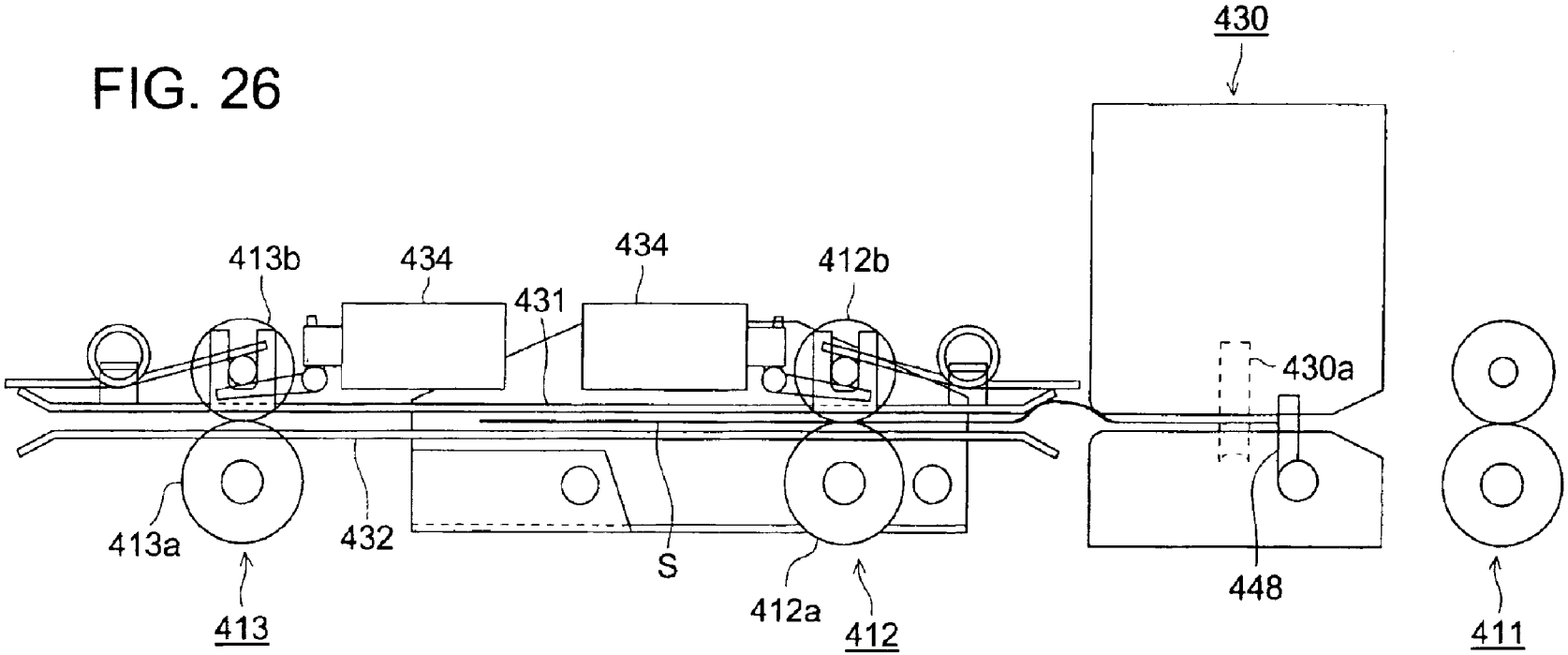
FIG. 26 is a side view of primary portions in a punching processing mechanism wherein punching processing is conducted on a paper.

After that, a motor that drives driving rollers 412*a* and 413*a* is rotated reversely. Then, the paper S is transported reversely to the upstream side in the paper transport direction by reverse rotations of the driving rollers 412*a* and 413*a*. In this case, stopper members 448 are rotated counterclockwise by about 90°, and are inserted in transport path 430*b* for paper S, thus, the trailing edge of the paper S transported in the reverse direction hits the stopper member 448. This condition is shown in FIG. 26. Then, the timer starts checking time after the reverse rotation of the motor is started, and the reverse rotation of the motor is stopped after the lapse of time for the trailing edge portion of the paper S to hit firmly the stopper member 448.

Incidentally, for assuring that the trailing edge portion of the paper S hits firmly the stopper member 448, an end portion of each of the upper guide plate 431 and the lower guide plate 432 at the upstream side in the paper transport direction is formed to be tilted outward so that paper S may be buckled in a space between punching means 430 and the aforesaid end portion, as shown in FIG. 26.

In the aforesaid manner, paper S is regulated in terms of its width, and its trailing edge hits the stopper member 448 to be regulated to be trued up also in the transport direction, thus, punching means 430 is driven so that the prescribed number of holes are punched on the paper S by punch 430*a*.

FIGS. 27(*a*)–27(*c*) are plan views showing various types of papers each being punched by a punching means. FIG. 27(*a*) shows an example (filing with two holes) wherein two holes h are punched in the vicinity of the trailing edge portion d of paper S, FIG. 27(*b*) shows an example (filing with three holes) wherein three holes h are punched in the vicinity of the trailing edge portion d of paper S, and FIG. 27(*c*) shows an example (filing with four holes) wherein four holes h are punched in the vicinity of the trailing edge portion d of paper S. Intervals of these plural holes h are standardized as shown with illustrated dimensions. Distance between a hole and a paper edge e that covers from the trailing edge portion d of paper S to hole h can be established freely, but it is generally in a range of 9–11 mm.

In a summary of controls of unillustrated control means in the operations above, the control means operates a timer to conduct at prescribed intervals a series of controls wherein rotations of transporting rollers 412 and 413 by a motor are stopped after the trailing edge of paper S is detected by sensor 447, solenoid 434 is turned on to make a stepping motor to rotate belt 443 to move width-regulating plates 441 and 442, solenoid 434 is turned off to make transporting rollers 412 and 413 to rotate reversely, stopper member 448 is rotated by a stepping motor, and reverse rotations of transporting rollers 412 and 413 are stopped to drive punching means 430.

Incidentally, the operation to rotate the stopper member 448 with a stepping motor can be conducted at any time, if the operation is conducted after the trailing edge portion of paper S is transported to the downstream side of the position of transport path 430*b* where the stopper member 448 is to be inserted in the paper transport direction.

Further, the control means may either be provided on image forming apparatus A or be provided on post-processing device FS.

Though driving rollers 412*a* and 413*a* are rotated reversely to transport paper S in the opposite direction so that the trailing edge portion of paper S may hit the stopper member 448 in the structure explained above, it is not always necessary to transport paper S in the opposite direction. Namely, it is also possible to employ the structure wherein transport of paper S is stopped under the condition that the trailing edge portion of paper S is still positioned in transport path 30*b* even if the leading edge portion of paper S has passed through the transport path 439*b* of punching means 430, and then, the width regulations as those described above are conducted, and under the condition that the paper S is nipped again between transporting rollers 412 and 413 and is stopped, the stopper member 448 is rotated to be brought into contact with the trailing edge portion of the paper S.

Further, an actuator that rotates crank lever 435 is not limited to the solenoid, and the crank lever 435 may also be rotated by a stepping motor. A member driven by the stepping motor may also be one in another shape without being the crank lever, naturally, and in a word, any construction may be employed, provided that pressure contact of driven rollers 412*b* and 413*b* respectively with driving rollers 412*a* and 413*a* can be canceled by a prescribed actuator.

Effect of the Invention

As is clear from the aforementioned explanation, the post-processing device of the invention exhibits the following effects.

(1) When a pair of folding rollers are made to be brought into contact with each other or to be separated from each other by a cam, and regular and reverse rotations of the paired folding rollers are switched in terms of driving simultaneously, the paired folding rollers hold functions of transporting rollers additionally. Therefore, paper transportation and folding processing can be conducted by accurate and stable operations. In addition, a paper fold-processing section can be constructed on a space saving basis.

(2) It is possible to realize, on a space saving basis, a post-processing device which makes it possible to conduct selectively various types of folding processing such as outside center fold, inside center fold, Z fold, outside three fold, inside three fold, double parallel fold and inside four fold, for papers ejected from an image forming apparatus.

(3) Since it is possible to fold papers without using a folding knife, damage of creases on papers can be prevented, resulting in an improvement of quality of appearance for folded papers.

Further, the invention has made it possible to provide an image forming apparatus having a paper post-processing device wherein a volume of a paper fold-processing section can be made small by conducting pressure contact and separation of the paired folding rollers with an opening/closing cam that is symmetrical about an axis at 180° and a load for driving the opening/closing cam can be reduced by providing an assist roller on the opening/closing cam.

The invention has further made it possible to provide an image recording apparatus equipped with a paper post-processing device wherein three fold-processing sections are arranged in series with a transport path (in the paper transport direction) on both sides of the transport path, a direction of the first fold-processing section in existence of a pair of folding rollers is made to be the same as that of the second fold-processing section in existence of a pair of folding rollers, and the third fold-processing section is arranged in the opposite direction, and a bypass path that is for only passing without conducting fold-processing is provided on each fold-processing section, and thereby, space saving is achieved, and seven types of folding such as Z fold, outside three fold, inside three fold, double parallel fold, inside four fold, outside center fold and inside center fold can be conducted, and it is not necessary to open again the folded paper for transporting.

Further, a post-processing device, an image forming system and a paper punching method in the invention make it possible to regulate papers so that the papers are not deviated both in the paper transport direction and the lateral direction under the simple structure, and to eliminate dispersion of positions of punched holes to avoid indecency in filing, which is an effect of the invention.

What is claimed is:

1. A paper post-processing apparatus for folding a paper ejected from an image forming apparatus at a paper folding process section, the paper folding process section comprising:

a pair of folding rollers contacting each other with a prescribed pressure, and each of the pair of folding rollers is rotatably supported by a shaft;

a pair of fold/transporting rollers each of which contacts with each of the pair of folding rollers with a prescribed pressure, and is rotatable;

a driving unit for driving the pair of folding rollers;

a folding roller moving unit for moving the pair of folding rollers to a pressure contact position and to a releasing position; and a drive switching unit for switching a rotation direction of the pair of folding rollers, wherein when transporting a paper without folding the paper at the paper folding process section, the holding roller moving unit moves the pair of folding rollers to a releasing position, and the drive switching unit switches the rotation direction of the pair of folding rollers to the same direction with each other; and when folding the paper at the paper folding process section, the holding roller moving unit moves the pair of folding rollers to the pressure contact position, and the drive switching unit switches the rotation direction of the pair of folding rollers to the reverse direction with each other.

2. The paper post-processing apparatus of claim 1, the paper folding process section further comprising:

a pair of gears, each of which is fixed to each shaft of the pair of folding rollers at the end part outside a paper feeding area, engaging with each other when the pair of folding rollers are in the pressure contact position; and an idler gear engaging selectively to the pair of gears, the idler gear moving to a release position when the pair of folding rollers are in the-pressure contact position, and the idler gear moving to an engaging position in-between the pair of gears to transfer a driving force when the pair of folding rollers are in the releasing position, wherein the drive switching unit switches the rotation direction of the pair of folding rollers by making the idler gear move to the engaging position and to the release position.

3. The paper post-processing apparatus of claim 2, wherein the drive switching unit comprises a cam and a follower roller following the cam.

4. The paper post-processing apparatus of claim 1, the paper folding process section further comprising:

an opening/closing cam provided on a supporting shaft of one of the pair of folding rollers;

a pressure contact member provided on a supporting shaft of the other one of the pair of folding rollers, and follows the opening/closing cam with pressure;

an assist member that is arranged at the position symmetrical with the position of the pressure contact member about the supporting shaft of the one of the pair of folding rollers, wherein the folding roller moving unit moves the pair of folding rollers to a pressure contact position and to a releasing position by driving the opening/closing cam.

5. The paper post-processing apparatus of claim 4, the drive switching unit comprising a drive switching cam for switching the rotation direction of the pair of folding rollers by cooperating with the opening/closing cam.

6. The paper post-processing apparatus of claim 4, wherein, the opening/closing cam is in a disc shape and is formed to be linearly symmetrical about a line crossing a center of the supporting shaft.

7. The paper post-processing apparatus of claim 4, wherein, the opening/closing cam is rotatable about the supporting shaft.

8. The paper post-processing apparatus of claim 4, wherein, each of the pressure contact member and the assist member is a follower roller in a disc shape and is rotatable about the respective supporting shaft.

9. The paper post-processing apparatus of claim 4, wherein, drive transmission among the opening/closing cam, the pressure contact member and the assist member is conducted through frictional contact.

10. The paper post-processing apparatus of claim 1, further comprising:

a sensor provided at an upstream side of a nipping position of the pair of folding rollers in the direction of paper transportation; and a control unit; wherein after the sensor detects the passage of a leading edge of the paper, the control unit counts prescribed pulses, then, stops driving rotation of the pair of folding rollers and rotation of the pair of fold/transporting rollers to stop the paper at the prescribed position.

11. An image recording apparatus comprising:

an image recording section for recording an image on a paper; and a paper post-processing section for folding the paper; the paper post processing section comprises a first folding process section, a second folding process section and a third folding process section, all the three folding process sections being provided in a paper transportation path and selectively conduct a paper folding process; the paper transportation path comprising a first transportation path, a second transportation path, a third transportation path, and a transportation bypath; wherein, a paper folded at the first folding process section is led to the second folding process section or to the third folding process section through the first transport path, a paper folded at the second folding process section is led to the third folding process section through the second transport path, a paper to be transported without folded at neither of the first, the second or the third folding process section is transported to an exit through the transportation bypath, wherein a paper folding direction at the first and the second folding process sections is reverse to a folding direction at the third folding process section.

12. The image recording apparatus of claim 11, each of the first, the second and the third folding process sections comprising:

a pair of folding rollers contacting each other with a prescribed pressure, and each of the pair of folding rollers is rotatably supported by a shaft;

a pair of fold/transporting rollers each of which contacts with each of the pair of folding rollers with a prescribed pressure, and is rotatable;

a driving unit for driving the pair of folding rollers;

a folding roller moving unit for moving the pair of folding rollers to a pressure contact position and to a releasing position; and a drive switching unit for switching a rotation direction of the pair of folding rollers, wherein when transporting a paper without folding the paper at the paper folding process section, the holding roller moving unit moves the pair of folding rollers to a releasing position, and the drive switching unit switches the rotation direction of the pair of folding rollers to the same direction with each other; and when folding the paper at the paper folding process section, the holding roller moving unit moves the pair of folding rollers to the pressure contact position, and the drive switching unit switch the rotation direction of the pair of folding rollers to the reverse direction with each other.

13. The image recording apparatus of claim 12, each of the first, the second and the third folding process sections further comprising a guide member for guiding a paper; the guide member is movable to a guide position for guiding a paper edge portion toward a nip position of each of the pair of folding rollers, and to a retreat position retreated from the guide position;

wherein, in the first folding process section the guide member is rotatable about an axis of upstream roller of the pair of fold/transporting rollers, in the second folding process section, the guide member is rotatable about an axis of downstream roller of the pair of fold/transporting rollers, and in the third folding process section, the guide member is movable back and forth in the vicinity of the nip position of the pair of folding rollers in the direction perpendicular to the transport direction for papers.

14. The image recording apparatus of claim 12, wherein both the first and the third folding process sections conduct fold processing to perform Z fold for an incoming paper whose image surface is facing to the pair of folding rollers of the first folding process section.

15. The image recording apparatus of claim 14, wherein a trailing edge of an image having been formed on a leading edge side of the incoming paper.

16. The image recording apparatus of claim 12, wherein both the first and the second folding process sections conduct fold processing to perform outside three fold, inside three fold and double parallel fold processing for an incoming paper whose image surface is facing to the pair of folding rollers of the first folding process section.

17. The image recording apparatus of claim 12, wherein all the first, the second and the third folding process sections conduct fold processing to perform inside four fold for an incoming paper whose image surface is facing to the pair of folding rollers of the first folding process section.

18. The image recording apparatus of claim 12, wherein the first folding process section conducts fold processing to perform outside center fold for an incoming paper whose image surface is facing to the pair of folding rollers of the first folding process section.

19. The image recording apparatus of claim 12, wherein the third folding process section conducts fold processing to perform inside center fold for an incoming paper whose image surface is facing to the pair of folding rollers of the first folding process section.

* * * * *